US005695909A

United States Patent [19]

Oya et al.

[11] Patent Number: 5,695,909

[45] Date of Patent: Dec. 9, 1997

[54] SILVER HALIDE PHOTOGRAPHIC MATERIAL

[75] Inventors: Toyohisa Oya; Kazuki Yamazaki; Harumi Watanabe, all of Kanagawa, Japan

[73] Assignee: Fuji Photo Film Co., Ltd., Kanagawa, Japan

[21] Appl. No.: 736,947

[22] Filed: Oct. 25, 1996

[30] Foreign Application Priority Data

Oct. 26, 1995 [JP] Japan ..... HEI. 7-279212

[51] Int. Cl.[6] ..... G03C 1/22; G03C 1/10

[52] U.S. Cl. ..... 430/264; 430/591; 430/592

[58] Field of Search ..... 430/591, 592, 430/264

[56] References Cited

U.S. PATENT DOCUMENTS

| | | | |
|---|---|---|---|
| 3,765,900 | 10/1973 | Depoorter et al. | 430/592 |
| 3,790,390 | 2/1974 | Shiba et al. | 430/592 |
| 4,493,889 | 1/1985 | Mihara et al. | 430/592 |
| 4,690,883 | 9/1987 | Kubodera et al. | 430/592 |
| 5,236,807 | 8/1993 | Inoue et al. | 430/591 |
| 5,286,598 | 2/1994 | Inoue et al. | 430/592 |
| 5,580,711 | 12/1996 | Kagawa et al. | 430/592 |

FOREIGN PATENT DOCUMENTS

| | | |
|---|---|---|
| 56-39458 | 9/1981 | Japan . |
| 61-77843 | 4/1986 | Japan . |
| 4265969 | 9/1992 | Japan . |

*Primary Examiner*—Richard L. Schilling

*Attorney, Agent, or Firm*—Sughrue, Mion, Zinn, Macpeak & Seas, PLLC

[57] ABSTRACT

A silver halide photographic material comprising a support having provided thereon a light-sensitive silver halide emulsion layer, said silver halide photographic material contains at least one spectral sensitizing dye represented by the following formula (I):

(I)

wherein $Z_{11}$ represents a nonmetal atomic group necessary for completing a 5- or 6-membered nitrogen-containing heterocyclic ring; $Q_{11}$ represents a nonmetal atomic group necessary for completing a 5-membered nitrogen-containing heterocyclic ring; $R_{11}$ represents a substituted or unsubstituted alkyl group; $R_{12}$ represents a straight chain or branched alkyl, alkenyl or alkynyl group each of which contains at least one carboxyl group and at least one ester bond, amido bond or ether bond; $L_{11}$ and $L_{12}$ each represents a methine group; $m_{11}$ represents 0 or 1; $m_{12}$ represents 0, 1 or 2: $X_1$ represents a counter ion necessary for neutralizing a charge; and $n_1$ represents a number of 0 or more necessary for neutralizing a charge in the molecule.

15 Claims, No Drawings

SILVER HALIDE PHOTOGRAPHIC MATERIAL

FIELD OF THE INVENTION

The present invention relates to a silver halide photographic material and, in particular, to a superhigh contrast silver halide photographic material for a photomechanical process including a novel spectral sensitizing dye.

BACKGROUND OF THE INVENTION

As one method of exposing a photographic material, a method of forming an image by a so-called scanner system which forms a negative image or a positive image corresponding to an original image by scanning an original image and exposing on a silver halide photographic material based on the signal of the image is known. Various recording apparatuses utilizing an image forming method by a scanner system are known, but a so-called dot generator method using a dot generator is nowadays widely used. A glow lamp, a xenon lamp, a mercury lamp, a tungsten lamp, a light emitting diode, and the like have been conventionally used as light sources for recording of these scanner recording apparatuses. However, each of these light sources has practical drawbacks such that an output is weak and a duration of life is short. There are scanners using coherent light sources such as an He—Ne laser, an argon laser, an He—Cd laser, a semiconductor laser and the like to cope with these drawbacks. Above all, scanners using an argon laser as a light source have been widely used because of capable of obtaining high output and diaphragming a laser beam small. Although high output can be obtained by a laser light, a photographic material of high sensitivity is advantageous for reducing the output to maintain a longer duration of life of a laser tube. It is also necessary to modify a laser beam using a slit or the like to obtain good halftone dots, and a photographic material of high sensitivity is needed to cope with the resultant fall in laser output.

A photographic material for laser light is in general spectrally sensitized with sensitizing dyes having absorption wavelengths in front and in the rear of the wavelength of the light source to provide the material with sensitivity to the light of the wavelength of the laser light. However, the residual colors due to sensitizing dyes are often seen in photographic materials after being processed, which in many cases deteriorates the commercial value of photographic materials.

Further, in recent years, working efficiency and rapidity are strongly desired also in the printing industry and wide demands for speedup of scanning and shortening of processing time of a photographic material have increased. To satisfy these needs in the printing industry, speedup of scanning, increase of line number for realization of high image quality and diaphragming of beams concerning an exposure equipment (a scanner, a plotter), and in a silver halide photographic material, high sensitivity, processing stability and rapid development processing are desired. Rapid development processing herein means a processing in which the time from an entrance of the tip of a film into an automatic processor till an exit of the tip of the film from a drying zone inclusive of passing through a developing tank, a crossover zone, a fixing tank, a crossover zone, a washing tank, and the drying zone is from 15 seconds to 60 seconds.

Examples of spectral sensitizing dyes used for these purposes include, for example, the merocyanine dyes having an acetylaminoalkyl group and an N-alkylcarbamoylaminoalkyl group disclosed in JP-A-4-265969 (the term "JP-A" as used herein means an "unexamined published Japanese patent application"), the merocyanine dyes having a methanesulfonylaminoethyl group disclosed in JP-A-61-77843 and the merocyanine dyes having an aliphatic group containing a thioether bond disclosed in JP-B-56-39458 (the term "JP-B" as used herein means an "examined Japanese patent publication). However, these spectral sensitizing dyes have problems such that these dyes insufficiently provide sensitization or they show desensitization when the addition amount is large. In addition, some of these dyes generate residual colors due to the dyes in photographic materials after being processed particularly when rapid processing and/or processing with reduced rate replenishment are/is carried out, accordingly, spectral sensitizing dyes which can resolve all of these problems have been strongly desired.

SUMMARY OF THE INVENTION

An object of the present invention is to provide a superhigh contrast silver halide photographic material which is high sensitive, high contrast, excellent in safe light capacities, generates less fluctuation in characteristics with a fatigued developing solution and storage with the lapse of time, and generates less residual color after processing.

The above object of the present invention has been attained by the following means.

A silver halide photographic material comprising a support having provided thereon a light-sensitive silver halide emulsion layer, said silver halide photographic material contains at least one spectral sensitizing dye represented by the following formula (I):

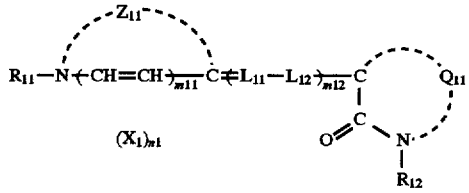

(I)

wherein $Z_{11}$ represents a nonmetal atomic group necessary for completing a 5- or 6-membered nitrogen-containing heterocyclic ring; $Q_{11}$ represents a nonmetal atomic group necessary for completing a 5-membered nitrogen-containing heterocyclic ring; $R_{11}$ represents a substituted or unsubstituted alkyl group; $R_{12}$ represents a straight chain or branched alkyl, alkenyl or alkynyl group each of which contains at least one carboxyl group and at least one ester bond, amido bond or ether bond; $L_{11}$ and $L_{12}$ each represents a methine group; $m_{11}$ represents 0 or 1; $m_{12}$ represents 0, 1 or 2: $X_1$ represents a counter ion necessary for neutralizing a charge; and $n_1$ represents a number of 0 or more necessary for neutralizing a charge in the molecule.

DETAILED DESCRIPTION OF THE INVENTION

The compound represented by formula (I) according to the present invention will be described in detail below.

The 5- or 6-membered nitrogen-containing heterocyclic ring completed by $Z_{11}$ may further be condensed, and may be saturated or unsaturated. The heterocyclic ring may contain an oxygen atom, a sulfur atom, a selenium atom or a tellurium atom as a hetero atom other than a nitrogen atom. Preferred examples include benzothiazole, benzoxazole, benzoselenazole, benzotellurazole, 2-quinoline, 4-quinoline, isoquinoline, pyridine, indolenine, naphthothiazole, naphthoxazole, naphthoselenazole, naphthotellurazole, oxazole, thiazoline, selenazoline, indoline, oxazoline, oxadiazole, thiadiazole, tetrazole, thiazole, selenazole, pyrimidine, imidazole, benzimidazole, naphthoimidazole, and imidazo[4,5-b]-quinoxaline.

Preferred examples of nitrogen-containing heterocyclic ring completed by $Z_{11}$ include oxazole, benzothiazole, naphtho[1,2-d]thiazole, naphtho[2,1-d]thiazole, naphtho-[2,3-d]thiazole, thiazole and thiazoline, and more preferred is benzothiazole.

These nitrogen-containing heterocyclic ring may have substituents and specific examples of substituents include a halogen atom (e.g., fluorine, chlorine, bromine), an unsubstituted alkyl group having from 1 to 12, preferably from 1 to 6, carbon atoms (e.g., methyl, ethyl, n-propyl, isopropyl, n-butyl, n-hexyl), an alkoxyl group having from 1 to 6, preferably from 1 to 4, carbon atoms (e.g., methoxy, ethoxy, propoxy, isopropoxy), a hydroxyl group, an alkoxycarbonyl group having from 2 to 12, preferably from 2 to 5, carbon atoms (e.g., methoxycarbonyl, ethoxycarbonyl), an alkylcarbonyloxy group having from 2 to 10, preferably from 2 to 5, carbon atoms (e.g., acetyloxy, propionyloxy), a phenyl group, a hydroxyphenyl group, a group having from 3 to 15, preferably from 5 to 10, carbon atoms and having an amido group and an aromatic ring at the same time (e.g., p-acetylaminophenyl, m-acetylaminophenyl, 2-pyrrolecarboxyamido, m-hydroxybenzamido, 2,6-dihydroxybenzamido, 2-furancarboxyamido, 2-thiophenecarboxyamido), a furyl group, and a pyrrolyl group, more preferred is an unsubstituted alkyl group having from 1 to 3 carbon atoms (e.g., methyl, ethyl, n-propyl, isopropyl), still more preferred is an alkoxyl group having from 1 to 3 carbon atoms (e.g., methoxy, ethoxy, propoxy, isopropoxy), and particularly preferred is a methyl group, a methoxy group or an ethoxy group.

The 5-membered nitrogen-containing heterocyclic ring formed by an atomic group represented by $Q_{11}$ may further be condensed and may be saturated or unsaturated. The heterocyclic ring may contain an oxygen atom, a sulfur atom, a selenium atom or a tellurium atom as a hetero atom other than a nitrogen atom. Preferred examples thereof include 2-pyrazolin-5-one, pyrazolidine-3,5-dione, imidazolin-5-one, hydantoin, 2- or 4-thiohydantoin, 2-iminooxazolidin-4-one, 2-oxazolin-5-one, 2-thiooxazolidine-2,4-dione, isooxazolin-5-one, 2-thiazolin-4-one, thiazolidin-4-one, thiazolidine-2,4-dione, rhodanine, thiazolidine-2,4-dithione, isorhodanine, indane-1,3-dione, thiophen-3-one, thiophen-3-one-1,1-dioxide, indolin-2-one, indolin-3-one, indazolin-3-one, 2-oxoindazolinium, 3-oxoindazolinium, indazolin-2-one, pyrazolo-[1,5-b] quinazolone, pyrazolo[1,5-b]benzimidazole, 3-oxo-2,3-dihydrobenzo[d]thiophene-1,1-dioxide, and 3-dicyanomethine-2,3-dihydrobenzo[d]thiophene-1,1-dioxide, more preferred are 3-alkylrhodanine, 3-alkyloxazolidine-2-thione-4-one, and 3-alkyl-2-thiohydantoin, and particularly preferred is 3-alkylrhodanine.

The atomic group represented by $Q_{11}$ may further have substituents. Examples of the substituents for the carbon atom include an alkyl group having from 1 to 18, preferably from 1 to 7, carbon atoms (e.g., methyl, ethyl, propyl, isopropyl, butyl, isobutyl), an aryl group having from 6 to 18 carbon atoms (e.g., phenyl, 2-naphthyl, 1-naphthyl), a heterocyclic group having from 1 to 15 carbon atoms (e.g., 2-thiazolyl, 2-furyl, 5-pyrazolyl, 2-pyrazyl, 2-pyrimidyl), a carboxyl group, a sulfo group, a cyano group, a nitro group, a halogen atom (e.g., fluorine, chlorine, iodine, bromine), a hydroxyl group, an alkoxyl group having from 1 to 8 carbon atoms (e.g., methoxy, ethoxy, benzyloxy, phenethyloxy), an acyloxy group having from 2 to 8 carbon atoms (e.g., acetyloxy), an alkoxycarbonyl group having from 2 to 8 carbon atoms, an acyl group having from 2 to 8 carbon atoms, a sulfamoyl group, a carbamoyl group, an alkanesulfonylaminocarbonyl group having from 2 to 8 carbon atoms (e.g., methanesulfonylaminocarbonyl), and an acylaminosulfonyl group having from 2 to 8 carbon atoms (e.g., acetylaminosulfonyl).

When a nitrogen atom is included in $Q_{11}$, examples of the substituents for the nitrogen atom include an alkyl group having from 1 to 18, preferably from 1 to 7, and more preferably from 1 to 4, carbon atoms (e.g., methyl, ethyl, propyl, isopropyl, butyl, isobutyl), an aryl group having from 6 to 18 carbon atoms (e.g., phenyl, 2-naphthyl, 1-naphthyl), and a heterocyclic group having from 1 to 15 carbon atoms (e.g., 2-thiazolyl, 2-furyl, 5-pyrazolyl, 2-pyrazyl, 2-pyrimidyl).

$R_{12}$ represents a straight chain or branched alkyl, alkenyl or alkynyl group having from 2 to 30, preferably from 4 to 20, carbon atoms, each of which contains at least one carboxyl group, and at least one ester bond, amido bond or ether bond. When an ester bond or an amido bond is included in the substituent, either of the two of the oxo-oxygen atom or the nitrogen atom and the carbonyl carbon constituting the ester bond or the amido bond may be positioned nearer to the heterocyclic ring represented by $Q_{11}$ but preferably the carbonyl group is positioned nearer to the heterocyclic ring. Further, these substituents may include two or more of an ester bond, an amido bond and an ether bond in combination. Specific examples of the substituents include a carboxyalkoxycarbonylmethyl group (e.g., carboxymethoxycarbonylmethyl, 2-[(2-carboxyethoxy) carbonyl]ethyl, (2-carboxyethoxy)carbonylmethyl, (2-carboxy-1-methylethoxy)carbonylmethyl, (3-carboxypropyloxy)carbonylmethyl), a carboxyalkylcarbonyloxyalkyl group (e.g., (2-carboxyethyl) carbonyloxymethyl, 2-[(2-carboxyethyl)carbonyloxy]ethyl, (3-carboxypropyl)carbonyloxymethyl, (4-carboxybutyl) carbonyloxyethyl), a carbonylalkoxyalkylcarbonyloxyalkyl group (e.g., carbonylmethoxymethylcarbonyloxymethyl), a 2-(Z)-carbonylvinylcarbonyloxymethyl group, a carbonylcarboxyalkyl group (e.g., 2-(2-carbonylethoxy)ethyl, 2-[2-(2-carbonylethylcarbonyloxy)ethoxy]ethyl), a carboxyalkylcarboxyaminoalkyl group (e.g., N-(3-carboxyethylcarboxy) aminomethyl, 2-[N-(3-carboxyethylcarboxy)amino]ethyl), a carboxyalkylcarbamoylalkyl group (e.g., 2-[(2-carboxyethyl)carbamoyl]ethyl), and an N-(carbonylethoxyethylcarbonyl)aminomethyl group, preferred are a carboxyalkoxycarbonylmethyl group and a carboxyalkylcarbonyloxyalkyl group, and particularly preferred are a carboxyethoxycarbonylmethyl group, a 2-[(2-carboxyethoxy)carbonyl]ethyl group, a (2-carboxy-1-methylethoxy)carbonylmethyl group, and a (3-carboxypropyloxy)carbonylmethyl group.

$R_{11}$ represents a substituted or unsubstituted alkyl group having from 1 to 12, preferably from 1 to 8, carbon atoms. Examples of the substituents include a hydroxyl group, a sulfo group, a sulfato group, a carboxyl group, a halogen atom (e.g., fluorine, chlorine, bromine), a substituted or unsubstituted alkoxyl group having from 1 to 6, preferably from 1 to 4, carbon atoms (the alkoxyl group may further be substituted with a sulfo group or a hydroxyl group), an alkoxycarbonyl group having from 2 to 5, preferably 2 or 3, carbon atoms, an alkylsulfonyl group having from 1 to 4 carbon atoms, a sulfamoyl group, a substituted or unsubstituted carbamoyl group (including a carbamoyl group substituted with an alkyl group having from 1 to 4 carbon atoms), a substituted phenyl group (preferred substituents include a sulfo group, a carboxyl group, a hydroxyl group), and a vinyl group. Preferred examples of the unsubstituted alkyl group include a methyl group, an ethyl group, a propyl group, and a butyl group, more preferred is an ethyl group. Examples of the substituted alkyl group include a hydroxyalkyl group (e.g., hydroxyethyl, 3-hydroxypropyl), a sulfoalkyl group (e.g., 2-sulfoethyl, 3-sulfopropyl, 3-sulfobutyl, 4-sulfobutyl, 2-hydroxy-3-sulfopropyl), a 2-sulfatoethyl group, a 3-sulfatopropyl group, a carboxyalkyl group (e.g., carboxymethyl, carboxyethyl, carboxypropyl), a trifluoromethyl group, a 2,2,2-trifluoroethyl group, a 2-(3-sulfopropoxy)ethyl group, a 2-(2-hydroxyethoxy)ethyl group, an ethoxycarbonylethyl group, a methylsulfonylethyl group, a sulfamoylalkyl group (e.g., 2-sulfamoylethyl, 2-carbamoylethyl, 2-N,N-dimethylcarbamoylethyl), a phenethyl group, a p-carboxyphenethyl group, an o-sulfophenethyl group, a p-hydroxyphenethyl group, an allyl group, and a phenoxyethyl group, and particularly preferred are a 2-sulfoethyl group, a 3-sulfopropyl group, a 3-sulfobutyl group and a 4-sulfobutyl group.

$L_{11}$ and $L_{12}$ each represents a methine group or a substituted methine group and they can form a ring (e.g., a 5- or 6-membered carbon ring) with other methine groups or an auxochrome. Examples of the substituents include a substituted or unsubstituted alkyl group (e.g., methyl, ethyl, n-propyl, isopropyl, cyclopropyl, butyl, 2-carboxyethyl), a substituted or unsubstituted aryl group (e.g., phenyl, naphthyl, anthryl, o-carboxyphenyl), a heterocyclic group (e.g., pyridyl, thienyl, furyl), a halogen atom (e.g., chlorine, bromine), an alkoxyl group (e.g., methoxy, ethoxy), an amino group (e.g., N,N-diphenylamino, N-methyl-N-phenylamino, N-methylpiperazino), and an alkylthio group (e.g., methylthio, ethylthio).

$X_1$ is included in the formula to show the presence or absence of a cation or an anion when a counter ion is necessary for neutralizing an ionic charge in the molecule of the compound. Whether the compound is a compound having a cation, an anion or no net ionic charge depends on the molecular structure or the substituents. Examples of representative cations as a counter ion include an inorganic or organic ammonium ion (e.g., a triethylammonium ion, a pyridinium ion), an alkali metal ion (e.g., a sodium ion, a potassium ion), and an alkaline earth metal ion (e.g., a calcium ion, a magnesium ion). Examples of representative anions as a counter ion include a halide ion (e.g., a fluoride ion, a chloride ion, a bromide ion, an iodide ion), an arylsulfonate ion (e.g., a p-toluenesulfonate ion, a p-chlorobenzenesulfonate ion), an alkylsulfonate ion (e.g., a methanesulfonate ion), an aryldisulfonate ion (e.g., a 1,3-benzenedisulfonate ion, a 1,5-naphthalenedisulfonate ion, a 2,6-naphthalenedisulfonate ion), an alkylsulfate ion (e.g., a methylsulfate ion, an ethylsulfate ion), a sulfate ion, a thiocyanate ion, a perchlorate ion, a tetrafluoroborate ion, a pyrophosphate ion, an acetate ion, a trifluoromethanesulfonate ion, and a hexafluorophosphate ion. As counter ions, ionic polymers, other organic compounds having a counter charge, or metal complex ions (e.g., a bis(1,2-benzenedithiolato)nickel(III)acid ion) can also be used.

Preferred as $X_1$ are a sodium ion, a potassium ion, a triethylammonium ion, a pyridinium ion, an iodide ion, a bromide ion, a chloride ion, a methanesulfonate ion, and a p-toluenesulfonate ion, more preferred are a sodium ion, a potassium ion and a triethylammonium ion.

Specific examples of the methine compounds represented by formula (I) according to the present invention are shown below, but it should not be construed as being limited thereto.

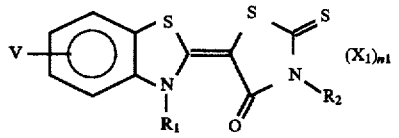

| Compound No. | V | $R_1$ | $R_2$ | $(X_1)_{n1}$ |
|---|---|---|---|---|
| I-1 | 5-MeO | $(CH_2)_4SO_3^-$ | $(CH_2)_2OC{=}O(CH_2)_2CO_2H$ | $N^+HEt_3$ |
| I-2 | H | $(CH_2)_3SO_3^-$ | $(CH_2)_2OC{=}O(CH_2)_2CO_2H$ | $N^+HEt_3$ |
| I-3 | 5-MeO | $(CH_2)_2CH(CH_3)SO_3^-$ | $(CH_2)_2OC{=}O(CH_2)_2CO_2^-$ | $2K^+$ |
| I-4 | 5-Me | $(CH_2)_4SO_3^-$ | $(CH_2)_2OC{=}O(CH_2)_2CO_2H$ | $N^+HEt_3$ |
| I-5 | 5-MeO | $(CH_2)_3SO_3^-$ | $(CH_2)_2OC{=}O(CH_2)_2CO_2^-$ | $2K^+$ |
| I-6 | 5-Me | $(CH_2)_3SO_3^-$ | $(CH_2)_2OC{=}O(CH_2)_2CO_2^-$ | $2K^+$ |
| I-7 | 5-MeO | $(CH_2)_4SO_3^-$ | $(CH_2)_2OC{=}OCH_2OCH_2CO_2^-$ | $2K^+$ |
| I-8 | H | $(CH_2)_4SO_3^-$ | $(CH_2)_2OC{=}OCH_2OCH_2CO_2^-$ | $2K^+$ |
| I-9 | 5-MeO | $(CH_2)_4SO_3^-$ | $(CH_2)_2C{=}OO(CH_2)_3CO_2^-$ | $2Na^+$ |
| I-10 | 5-MeO | $(CH_2)_3SO_3^-$ | $(CH_2)_2C{=}OO(CH_2)_3CO_2^-$ | $2K^+$ |
| I-11 | 5-MeO | $(CH_2)_4SO_3^-$ | $(CH_2)_2C{=}OOCH(CH_3)CO_2^-$ | $2K^+$ |
| I-12 | 5-MeO | $(CH_2)_4SO_3^-$ | $(CH_2)_2OC{=}OCH{=}CHCO_2^-$ | $2K^+$ |
| I-13 | 5-Me | $(CH_2)_4SO_3^-$ | $(CH_2)_2OC{=}OCH{=}CHCO_2^-$ | $2K^+$ |
| I-14 | 5-MeO | $(CH_2)_4SO_3^-$ | $(CH_2)_2O(CH_2)_2OC{=}O(CH_2)_2CO_2^-$ | $2K^+$ |
| I-15 | 5-MeO | $(CH_2)_2CH(CH_3)SO_3^-$ | $(CH_2)_2O(CH_2)_2OC{=}O(CH_2)_2CO_2^-$ | $2K^+$ |
| I-16 | H | $(CH_2)_4SO_3^-$ | $(CH_2)_2O(CH_2)_2CO_2^-$ | $2K^+$ |
| I-17 | 5-MeO | $(CH_2)_4SO_3^-$ | $(CH_2)_2O(CH_2)_2CO_2H$ | $N^+HEt_3$ |
| I-18 | 5-MeO | $(CH_2)_4SO_3^-$ | $CH_2C{=}ONHCH_2CO_2^-$ | $2K^+$ |
| I-19 | 5-MeO | $(CH_2)_4SO_3^-$ | $(CH_2)_2NHC{=}O(CH_2)_2CO_2H$ | $N^+HEt_3$ |
| I-20 | 5-MeO | $(CH_2)_4SO_3^-$ | $(CH_2)_2NHC{=}ONH(CH_2)_2CO_2^-$ | $2K^+$ |
| I-21 | 5-Cl | $(CH_2)_4SO_3^-$ | $(CH_2)_2OC{=}O(CH_2)_2CO_2H$ | $N^+HEt_3$ |
| I-22 | 5-Cl | $(CH_2)_3SO_3^-$ | $(CH_2)_2OC{=}O(CH_2)_2CO_2H$ | $N^+HEt_3$ |
| I-23 | 5-Cl | $(CH_2)_2SO_3^-$ | $(CH_2)_2OC{=}O(CH_2)_2CO_2^-$ | $2K^+$ |
| I-24 | 5-Br | $(CH_2)_4SO_3^-$ | $(CH_2)_2OC{=}O(CH_2)_2CO_2H$ | $N^+HEt_3$ |
| I-25 | 5-Cl | $(CH_2)_4SO_3^-$ | $(CH_2)_2OC{=}OCH_2OCH_2CO_2^-$ | $2K^+$ |

-continued
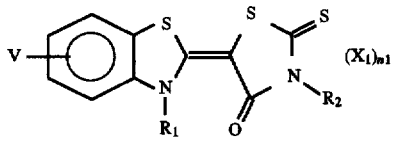
| Compound No. | V | $R_1$ | $R_2$ | $(X_1)_{n1}$ |
|---|---|---|---|---|
| I-26 | 5-Cl | $(CH_2)_4SO_3^-$ | $(CH_2)_2OC{=}OCH_2OCH_2CO_2^-$ | $2K^+$ |
| I-27 | 5-Cl | $(CH_2)_4SO_3^-$ | $CH_2C{=}OO(CH_2)_3CO_2^-$ | $2Na^+$ |
| I-28 | 5-Cl | $(CH_2)_3SO_3^-$ | $CH_2C{=}OO(CH_2)_3CO_2^-$ | $2K^+$ |
| I-29 | 5-Cl | $(CH_2)_4SO_3^-$ | $CH_2C{=}ONHCH_2CO_2^-$ | $2K^+$ |
| I-30 | 5-Cl | $(CH_2)_4SO_3^-$ | $(CH_2)_2NHC{=}O(CH_2)_2CO_2H$ | $N^+HEt_3$ |
I-31
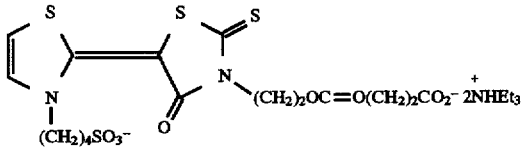
I-32
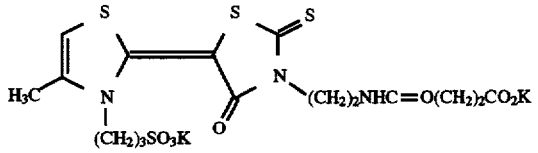
I-33
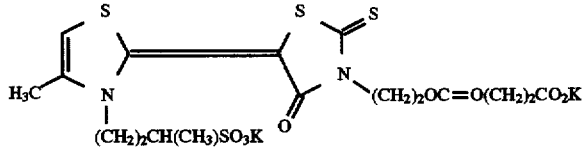
I-34
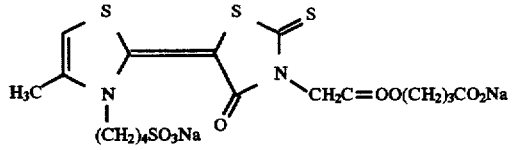
I-35
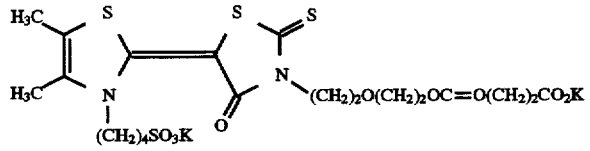
I-36
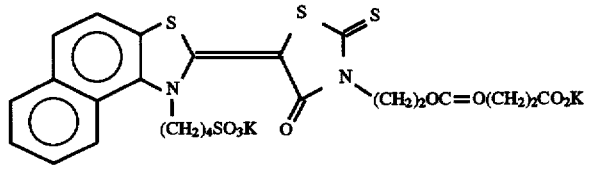

-continued
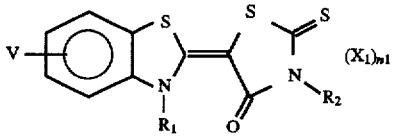
| Compound No. | V | $R_1$ | $R_2$ | $(X_1)_{n1}$ |
|---|---|---|---|---|
| I-37 | 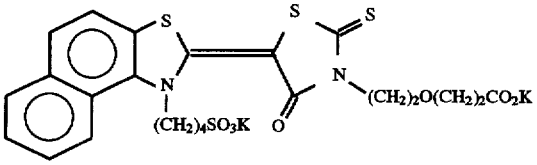 | | | |
| I-38 | 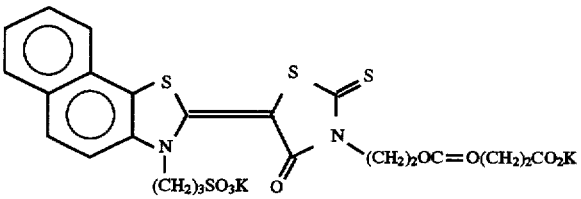 | | | |
| I-39 | 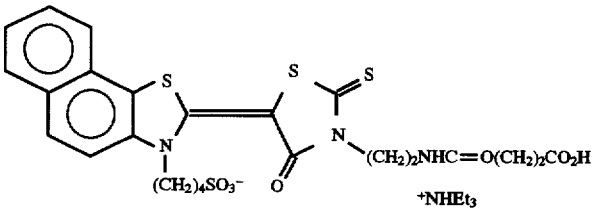 | | | |
| I-40 | 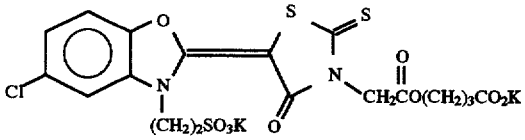 | | | |
| I-41 | 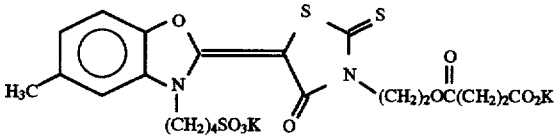 | | | |
| I-42 | 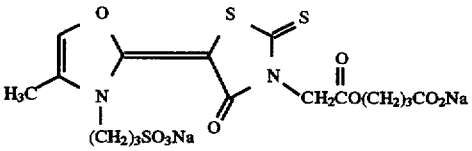 | | | |

-continued
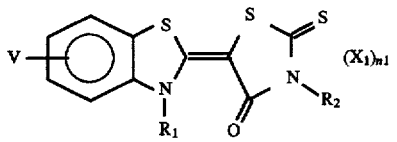
| Compound No. | V | $R_1$ | $R_2$ | $(X_1)_{n1}$ |
|---|---|---|---|---|
| I-43 | 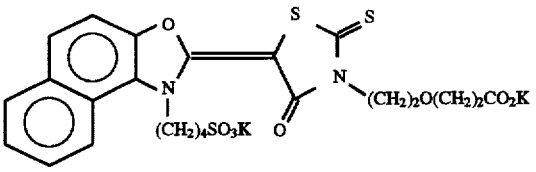 | | | |
| I-44 | 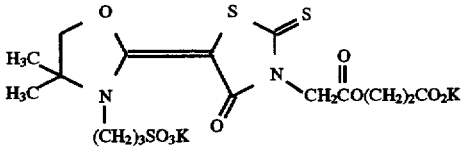 | | | |
| I-45 | 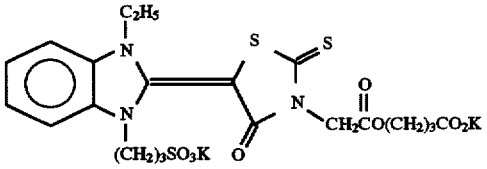 | | | |
| I-46 | 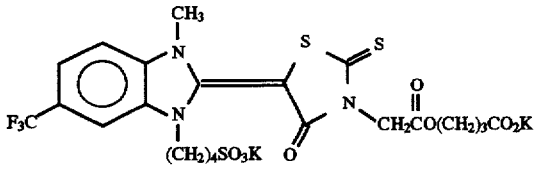 | | | |
| I-47 | 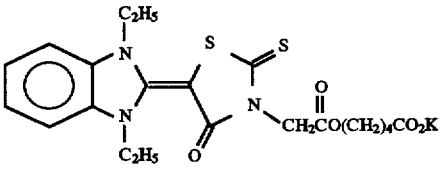 | | | |
| I-48 | 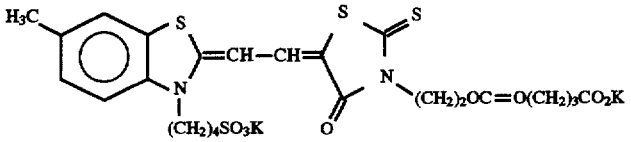 | | | |

-continued
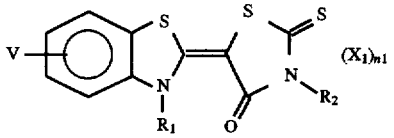
| Compound No. | V | $R_1$ | $R_2$ | $(X_1)_{n1}$ |
|---|---|---|---|---|
| I-49 | 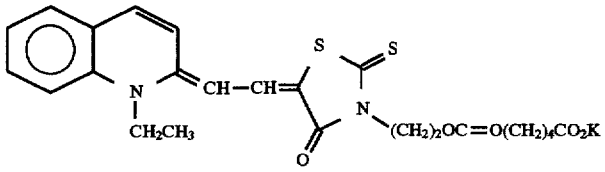 | | | |
| I-50 | 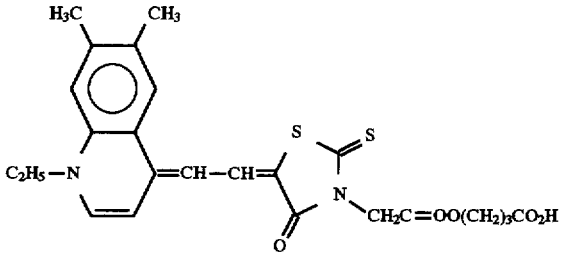 | | | |
| I-51 | 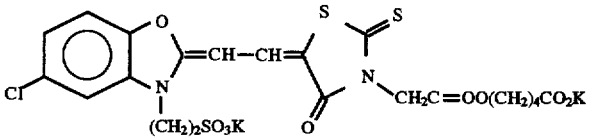 | | | |
| I-52 | 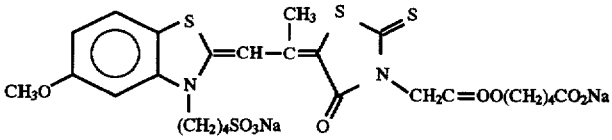 | | | |
| I-53 | 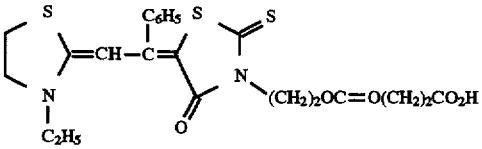 | | | |
| I-54 | 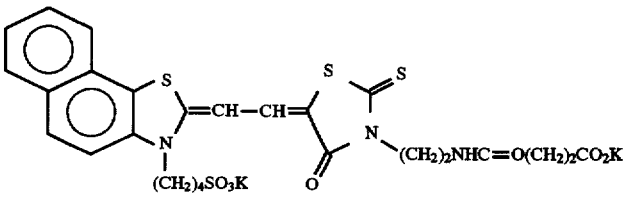 | | | |

-continued
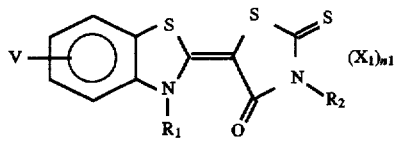
| Compound No. | V | $R_1$ | $R_2$ | $(X_1)_{n1}$ |
|---|---|---|---|---|
| I-55 | 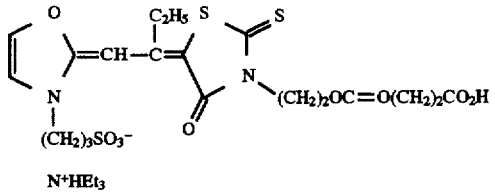 | | | |
| I-56 | 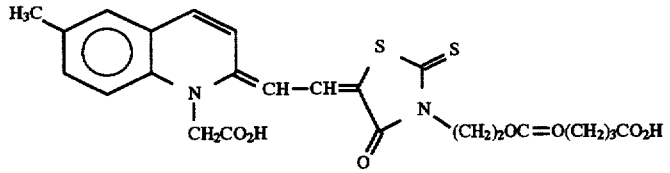 | | | |
| I-57 | 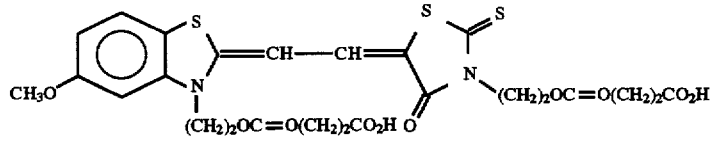 | | | |
| I-58 | 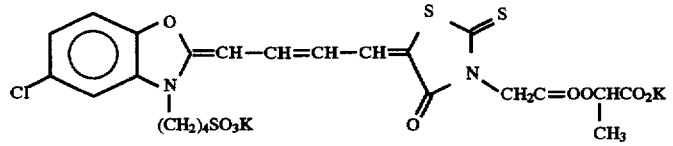 | | | |
| I-59 | 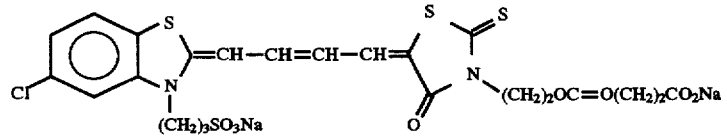 | | | |
| I-60 | 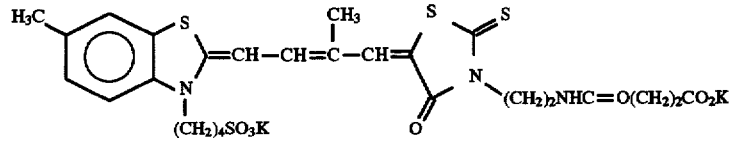 | | | |

-continued

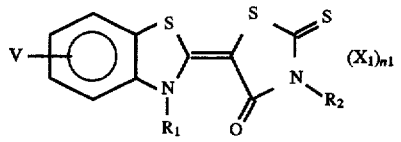

| Compound No. | V | $R_1$ | $R_2$ | $(X_1)_{n1}$ |
|---|---|---|---|---|
| I-61 | 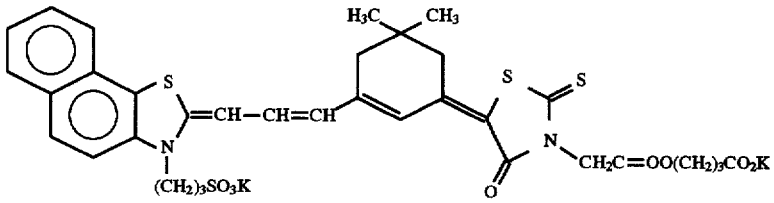 | | | |

The spectral sensitizing dyes represented by formula (I) according to the present invention can be easily synthesized by one skilled in the art referring to, for example, F. M. Harmer, *Heterocyclic Compounds—Cyanine Dyes and Related Compounds*, John Wiley & Sons, New York, London (1964), D. M. Starmer, *Heterocyclic Compounds—Special Topics in Heterocyclic Chemistry*, pp. 482 to 515, John Wiley & Sons, New York, London (1977), and the synthesis examples of the merocyanine dyes disclosed in the literature cited therein.

The formation of the substituents represented by in formula (I) may be conducted at any stage of the synthesis of the methine compound represented by formula (I) by any known synthesis methods. For example, when an ester bond is contained in the substituent, a synthesis method in which an alcohol and an acid anhydride are reacted, a synthesis method in which an alcohol and an acid halide are reacted, a mixed acid anhydride method, and a synthesis method in which an alcohol and a carboxylic acid are reacted in the presence of a condensing agent can be used. As a condensing agent which can be used in the reaction, dicyclohexylcarbodiimide, carbonyldiimidazole, N,N'-disuccinimidyl carbonate, and 1-ethyl-3-(3'-dimethylaminopropyl)carbodiimide can be cited. When an amido bond is contained in the substituent, a synthesis method in which a carboxylic acid and amine are reacted in the presence of a condensing agent and a synthesis method in which an acid halide and amine are reacted can be used. The carboxyl group contained in the substituents can also be synthesized from an alcohol or aldehyde by an oxidation reaction.

For the inclusion of the sensitizing dyes for use in the present invention in the silver halide emulsion of the present invention, they may be directly dispersed in the emulsion, or they may be dissolved in water, a single or mixed solvent of methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide, etc., and then added to the emulsion.

In addition, various methods can be used for the inclusion of the sensitizing dyes in the emulsion, for example, a method in which the sensitizing dyes are dissolved in a volatile organic solvent, the solution is dispersed in water or hydrophilic colloid and this dispersion is added to the emulsion as disclosed in U.S. Pat. No. 3,469,987, a method in which the sensitizing dyes are dissolved in acid and the solution is added to the emulsion, or the sensitizing dyes are added to the emulsion as an aqueous solution coexisting with acid or base as disclosed in JP-B-44-23389 (the term "JP-B" as used herein means an "examined Japanese patent publication"), JP-B-44-27555 and JP-B-57-22091, a method in which the dyes are added to the emulsion as an aqueous solution or colloidal dispersion coexisting with a surfactant as disclosed in U.S. Pat. Nos. 3,822,135 and 4,006,025, a method in which the dyes are directly dispersed in a hydrophilic colloid and the dispersion is added to the emulsion as disclosed in JP-A-53-102733 and JP-A-58-105141, or a method in which the dyes are dissolved using a compound capable of red-shifting and the solution is added to the emulsion as disclosed in JP-A-51-74624 can be used. Further, ultrasonic waves can be used for dissolution.

The time of the addition of the sensitizing dyes for use in the present invention to the emulsion of the present invention may be at any stage of the preparation of the emulsion recognized as useful hitherto. For example, they may be added at any stage if it is before coating, i.e., before grain formation stage of silver halide grains or/and before desalting stage, during desalting stage and/or after desalting and before beginning of chemical sensitization, as disclosed in U.S. Pat. Nos. 2,735,766, 3,628,960, 4,183,756, 4,225,666, JP-A-58-184142 and JP-A-60-196749, or immediately before or during chemical ripening, after chemical ripening and before coating as disclosed in JP-A-58-113920. Also, as disclosed in U.S. Pat. No. 4,225,666 and JP-A-58-7629, the sensitizing dyes can be used as a single compound alone or in combination with compounds having different structures, and they can be divided and added separately, for example, one part of them is added during grain formation stage and the remaining is added during chemical ripening or after the completion of chemical ripening, otherwise one part is added prior to chemical ripening or during ripening stage and the remaining after completion of chemical sensitization. The kinds of compounds added separately and combinations of compounds may be varied.

In the present invention, the compound represented by formula (I) is added preferably in an amount of from $1\times10^{-5}$ to $1\times10^{-2}$ mol, particularly preferably from $10^{-5}$ to $5\times10^{-3}$ mol, per mol of the silver.

The silver halide emulsion prepared according to the present invention can be used for both of black-and-white photographic materials and color photographic materials. As black-and-white photographic materials, films for printing, X-ray films, films for general photographing, and black-and-white papers, and as color photographic materials, color papers, color negative films for photographing, and color reversal films can be cited, but is particularly preferably used in superhigh contrast silver halide photographic materials for a photomechanical process.

It is preferred that at least one or more hydrazine derivatives represented by the following formula (II) are contained in silver halide emulsion layers or other hydrophilic colloid layers of the silver halide photographic material according to the present invention:

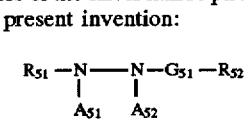

(II)

wherein $R_{51}$ represents an aliphatic or aromatic group; $R_{52}$ represents a hydrogen atom, an alkyl group, an aryl group, an unsaturated heterocyclic group, an alkoxyl group, an aryloxy group, an amino group or a hydrazino group; $G_{51}$ represents

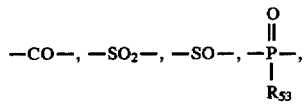

$-CO-CO-$, a thiocarbonyl group, or an iminomethylene group; $A_{51}$ and $A_{52}$ each represents a hydrogen atom, or either of them represents a hydrogen atom and the other represents a substituted or unsubstituted alkylsulfonyl group, or a substituted or unsubstituted arylsulfonyl group, or a substituted or unsubstituted acyl group; and $R_{53}$ has the same meaning as defined in $R_{52}$ and may be different from $R_{52}$.

In formula (II), the aliphatic group represented by $R_{51}$ preferably has from 1 to 30 carbon atoms, and is particularly preferably a straight chain, branched or cyclic alkyl group having from 1 to 20 carbon atoms. Herein, the branched alkyl group may be cyclized to form a saturated heterocyclic ring containing one or more hetero atoms therein.

The aromatic group represented by $R_{51}$ in formula (II) is a monocyclic or bicyclic aryl group or an unsaturated heterocyclic group. Here, the unsaturated heterocyclic group may be condensed with a monocyclic or bicyclic aryl group to form a heteroaryl group. Examples of the aromatic group include a benzene ring, a naphthalene ring, a pyridine ring, a pyrimidine ring, an imidazole ring, a pyrazole ring, a quinoline ring, an isoquinoline ring, a benzimidazole ring, a thiazole ring, and a benzothiazole ring, with that containing a benzene ring being preferred. $R_{51}$ is particularly preferably an aryl group.

The aliphatic group or aromatic group represented by $R_{51}$ may be substituted, and representative substituents include, for example, an alkyl group, an alkenyl group, an alkynyl group, an aryl group, a group containing a heterocyclic ring, a pyridinium group, a hydroxyl group, an alkoxyl group, an aryloxy group, an acyloxy group, an alkyl- or arylsulfonyloxy group, an amino group, a carbonamido group, a sulfonamido group, a ureido group, a thioureido group, a semicarbazido group, a thiosemicarbazido group, a urethane group, a group having a hydrazide structure, a group having a quaternary ammonium structure, an alkyl- or arylthio group, an alkyl- or arylsulfonyl group, an alkyl- or arylsulfinyl group, a carboxyl group, a sulfo group, an acyl group, an alkoxy- or aryloxycarbonyl group, a carbamoyl group, a sulfamoyl group, a halogen atom, a cyano group, a phosphoric acid amido group, a diacylamino group, an imido group, a group having an acylurea structure, a group containing a selenium atom or a tellurium atom, and a group having a tertiary or quaternary sulfonium structure, and preferred substituents include a straight chain, branched or cyclic alkyl group (preferably having from 1 to 20 carbon atoms), an aralkyl group (preferably monocyclic or bicyclic and the alkyl moiety of which has from 1 to 3 carbon atoms), an alkoxyl group (preferably having from 1 to 20 carbon atoms), a substituted amino group (preferably an amino group substituted with an alkyl group having from 1 to 20 carbon atoms), an acylamino group (preferably having from 2 to 30 carbon atoms), a sulfonamido group (preferably having from 1 to 30 carbon atoms), a ureido group (preferably having from 1 to 30 carbon atoms), and a phosphoric acid amido group (preferably having from 1 to 30 carbon atoms).

The alkyl group represented by $R_{52}$ in formula (II) is preferably an alkyl group having from 1 to 4 carbon atoms, and the aryl group represented by $R_{52}$ in formula (II) is preferably a monocyclic or bicyclic aryl group, for example, an aryl group which contains a benzene ring.

The unsaturated heterocyclic group is a 5- or 6-membered compound containing at least one nitrogen, oxygen or sulfur atom, for example, an imidazolyl group, a pyrazolyl group, a triazolyl group, a tetrazolyl group, a pyridyl group, a pyridinium group, a quinolinium group or a quinolyl group. A pyridyl group and a pyridinium group are particularly preferred.

An alkoxyl group having from 1 to 8 carbon atoms is preferred as the alkoxyl group, a monocyclic aryloxy group is preferred an the aryloxy group, an unsubstituted amino group, an alkylamino group having from 1 to 10 carbon atoms and an arylamino group are preferred as the amino group.

$R_{52}$ may be substituted, and groups cited as substituents for $R_{51}$ are applied to $R_{52}$ as preferred substituents.

Preferred groups of the groups represented by $R_{52}$ are, when $G_{51}$ represents a —CO— group, a hydrogen atom, an alkyl group (e.g., methyl, monofluoromethyl, difluoromethyl, trifluoromethyl, 3-hydroxypropyl, 3-methanesulfonamidopropyl, phenylsulfonylmethyl, pyridinium methyl), an aralkyl group (e.g., o-hydroxybenzyl), and an aryl group (e.g., phenyl, 3,5-dichlorophenyl, o-methanesulfonamidophenyl, 4-methanesulfonylphenyl, 2-hydroxymethylphenyl), and a hydrogen atom, a monofluoromethyl group, a difluoromethyl group and a trifluoromethyl group are particularly preferred of them.

Further, when $G_{51}$ represents an —$SO_2$— group, preferred groups represented by $R_{52}$ are an alkyl group (e.g., methyl), an aralkyl group (e.g., o-hydroxybenzyl), an aryl group (e.g., phenyl), and a substituted amino group (e.g., dimethylamino).

When $G_{51}$ represents a —COCO— group, $R_{52}$ preferably represents an alkoxyl group, an aryloxy group, or an amino group.

$G_{51}$ in formula (II) preferably represents a —CO— group or a —COCO— group, and most preferably a —CO— group.

Further, $R_{52}$ may be a group such that the —$G_{51}$—$R_{52}$ moiety is cleaved from the remainder of the molecule and a cyclization reaction occurs to form a ring structure in which the atoms of the —$G_{51}$—$R_{52}$ moiety is contained, and the example thereof is disclosed in JP-A-63-29751.

$A_{51}$ and $A_{52}$ each represents a hydrogen atom, an alkyl- or arylsulfonyl group having 20 or less carbon atoms (preferably phenylsulfonyl or substituted phenylsulfonyl having the total of the Hammett's substituent constant of −0.5 or more), an acyl group having 20 or less carbon atoms (preferably benzoyl or substituted benzoyl having the total of the Hammett's substituent constant of −0.5 or more, or straight chain, branched or cyclic, substituted or unsubstituted aliphatic acyl (substituents include, e.g., halogen, ether, sulfonamido, carbonamido, hydroxyl, carboxyl, sulfonic acid)).

$A_{51}$ and $A_{52}$ most preferably represent a hydrogen atom.

The substituents represented by $R_{51}$ and $R_{52}$ in formula (II) may further be substituted and preferred substituents include those cited as the substituents for $R_{51}$. Substituent may be substituted multiple times, that is, further substituent, substituent of the substituent, substituent of the substituent of the substituent . . . , and preferred substituents are also those cited as substituents for $R_{51}$.

$R_{51}$ or $R_{52}$ in formula (II) may include a ballast group or a polymer which are normally used in immobile photographic additives such as couplers. Such a ballast group has 8 or more carbon atoms and is a group which is photographically comparatively inactive and can be selected from, for example, an alkyl group, an aralkyl group, an alkoxyl group, a phenyl group, an alkylphenyl group, a phenoxy group or an alkylphenoxy group. Further, those disclosed, for example, in JP-A-1-100530 can be cited as such a polymer.

$R_{51}$ or $R_{52}$ in formula (II) may include a group which is strong adsorbed onto the surface of silver halide grains. Examples of such an adsorptive group include an alkylthio group, an arylthio group, a thiourea group, a heterocyclic thioamido group, a mercapto heterocyclic group, and a triazole group as disclosed in U.S. Pat. Nos. 4,385,108, 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, and JP-A-63-234246.

The preferred hydrazine derivative for use in the present invention is a hydrazine derivative in which represents a ballast group, a group which accelerates adsorption onto the surface of silver halide grains, a group having a quaternary ammonium structure or a phenyl group having an alkylthio group via a sulfonamido group, an acylamino group or a ureido group, $G_{51}$ represents a —CO— group, and $R_{52}$ represents a hydrogen atom, a substituted alkyl group, or a substituted aryl group (preferred substituents include an electron attractive group or a 2-hydroxymethyl group). In addition, any combinations of the selection from the above $R_{51}$ and $R_{52}$ are possible and preferred.

Further, a hydrazine derivative having an anionic group or a nonionic group which forms an intramolecular hydrogen bond with the hydrogen atom of the hydrazine in the vicinity of the hydrazine group is preferably used in the present invention.

More specifically, carboxylic acid, sulfonic acid, sulfinic acid, phosphoric acid, phosphonic acid and the salts of these acids can be cited as such an anionic group. A nonionic group which forms an intramolecular hydrogen bond with the hydrogen atom of the hydrazine is a group the lone pair of which forms a hydrogen bond with the hydrogen atom of the hydrazine to form a 5- to 7-membered ring and which has at least one oxygen, nitrogen, sulfur or phosphorus atom. Examples of nonionic groups include an alkoxyl group, an amino group, an alkylthio group, a carbonyl group, a carbamoyl group, an alkoxycarbonyl group, a urethane group, a ureido group, an acyloxy group, and an acylamino group.

An anionic group is preferred and carboxylic acid and the salt thereof are most preferred.

A nucleating agent preferably used in the present invention is represented by the following formula (III), (IV), or (V):

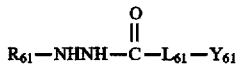

(III)

wherein $R_{61}$ represents an alkyl group, an aryl group or a heterocyclic group; $L_{61}$ represents a divalent linking group having an electron attractive group; and $Y_{61}$ represents an anionic group or a nonionic group which forms an intramolecular hydrogen bond with the hydrogen atom of the hydrazine;

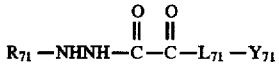

(IV)

wherein $R_{71}$ represents an alkyl group, an aryl group or a heterocyclic group; $L_{71}$ represents a divalent linking group; and $Y_{71}$ represents an anionic group or a nonionic group which forms an intramolecular hydrogen bond with the hydrogen atom of the hydrazine;

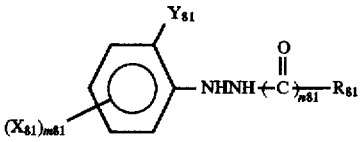

(V)

wherein $X_{81}$ represents a group capable of substitution on a benzene ring; $R_{81}$ represents an alkyl group, an alkenyl group, an alkynyl group, an aryl group, a heterocyclic group, an alkoxyl group or an amino group; $Y_{81}$ represents an anionic group or a nonionic group which forms an intramolecular hydrogen bond with the hydrogen atom of the hydrazine; $m_{81}$ represents 0 or an integer of 1, 2, 3 or 4; and $n_{81}$ is 1 or 2, and when $n_{81}$ is 1, $R_{81}$ has an electron attractive group.

Formulae (III), (IV) and (V) are described in further detail.

The alkyl group represented by $R_{61}$ and $R_{71}$ is a straight chain, branched or cyclic alkyl group having from 1 to 16, preferably from 1 to 12, carbon atoms, e.g., methyl, ethyl, propyl, isopropyl, t-butyl, allyl, propargyl, 2-butenyl, 2-hydroxyethyl, benzyl, benzhydryl, trityl, 4-methylbenzyl, 2-methoxyethyl, cyclopentyl, or 2-acetamidoethyl.

The aryl group is an aryl group having from 6 to 24, preferably from 6 to 12, carbon atoms, e.g., phenyl, naphthyl, p-alkoxyphenyl, p-sulfonamidophenyl, p-ureidophenyl, or p-amidophenyl. The heterocyclic group is a saturated or unsaturated 5- or 6-membered heterocyclic ring having from 1 to 5 carbon atoms and containing one or more of an oxygen atom, a nitrogen atom or a sulfur atom, and the number of the hetero atom and the kind of the element constituting the ring may be one or more, e.g., 2-furyl, 2-thienyl or 4-pyridyl.

$R_{61}$ and $R_{71}$ preferably represent an aryl group, an aromatic heterocyclic group or a methyl group substituted with an aryl group, more preferably an aryl group (e.g., phenyl, naphthyl). $R_{61}$ and $R_{71}$ may be substituted with substituents and examples of the substituents include, for example, an alkyl group, an aralkyl group, an alkoxyl group, an amino group substituted with an alkyl or aryl group, an amido group, a sulfonamido group, a ureido group, a urethane group, an aryloxy group, a sulfamoyl group, a carbamoyl group, an aryl group, an alkylthio group, an arylthio group, a sulfonyl group, a sulfinyl group, a hydroxyl group, a halogen atom, a cyano group, a sulfo group, a carboxyl group, and a phosphoric acid amido group. These groups may further be substituted. Of the above groups, a sulfonamido group, a ureido group, an amido group, an alkoxyl group and a urethane group are preferred, and a sulfonamido group and a ureido group are more preferred. These groups may be linked with each other to form a ring, if possible.

The alkyl group, aryl group and heterocyclic group described for $R_{61}$ can be applied to $R_{81}$. The alkenyl group represents an alkenyl group having from 2 to 18, preferably from 2 to 10, carbon atoms, e.g., vinyl or 2-styryl. The alkynyl group represents an alkynyl group having from 2 to 18, preferably from 2 to 10, carbon atoms, e.g., ethynyl or phenylethynyl. The alkoxyl group represents a straight chain, branched or cyclic alkoxyl group having from 1 to 16, preferably from 1 to 10, carbon atoms, e.g., methoxy, isopropoxy, or benzyloxy. The amino group represents an amino group having from 0 to 16, preferably from 1 to 10, carbon atoms, e.g., ethylamino, benzylamino or phenylamino.

When $n_{81}$ is 1, $R_{81}$ preferably represents an alkyl group, an alkenyl group or an alkynyl group, and when $n_{81}$ is 2, $R_{81}$ preferably represents an amino group or an alkoxyl group.

The electron attractive group contained in $R_{81}$ has a Hammett's $\sigma_m$ value of 0.2 or more, preferably 0.3 or more. Examples thereof include a halogen atom (fluorine, chlorine, bromine), a cyano group, a sulfonyl group (e.g., methanesulfonyl, benzenesulfonyl), a sulfinyl group (e.g., methanesulfinyl), an acyl group (e.g., acetyl, benzoyl), an oxycarbonyl group (e.g., methoxycarbonyl), a carbamoyl group (e.g., N-methylcarbamoyl), a sulfamoyl group (e.g., methylsulfamoyl), an alkyl group substituted with a halogen atom (e.g., trifluoromethyl), a heterocyclic group (e.g., 2-benzoxazolyl, pyrrolo), and a quaternary onium group (e.g., triphenylphosphonium, trialkylammonium, pyridinium). As having an electron attractive group, e.g., trifluoromethyl, difluoromethyl, pentafluoroethyl, cyanomethyl, methanesulfonylmethyl, acetylethyl, trifluoromethylethynyl, ethoxycarbonylmethyl can be cited.

$L_{61}$ and $L_{71}$ represent a divalent linking group, e.g., an alkylene group, an alkenylene group, an alkynylene group, an arylene group, a divalent heterocyclic group or a group formed by linking these groups with —O—, —S—, —NH—, —CO—, —SO2— alone or in combination. $L_{61}$ and $L_{71}$ may be substituted with the groups cited as the substituents for $R_{61}$. The alkylene group represents, e.g., methylene, ethylene, trimethylene, pentamethylene, octamethylene, propylene, 2-buten-1,4-yl, 2-butyn-1,4-yl, or p-xylylene. The alkenylene group represents, e.g., vinylene. The alkynylene group represents ethynylene. The arylene group represents, e.g., phenylene. The divalent heterocyclic group represents, e.g., furan-1,4-diyl. $L_{61}$ preferably represents an alkylene group, an alkenylene group, an alkynylene group or arylene group, more preferably an alkylene group, and an alkylene group of a chain length of 2 or 3 carbon atoms is most preferred. $L_{71}$ preferably represents an alkylene group, an arylene group, —NH-alkylene-, —O-alkylene- or —NH-arylene-, and more preferably —NH-alkylene- or —O-alkylene-.

The electron attractive group contained in $R_{81}$ can be applied to the electron attractive group contained in $L_{61}$. For example, tetrafluoroethylene, fluoromethylene, hexafluorotrimethylene, perfluorophenylene, difluorovinylene, cyanomethylene or methanesulfonylethylene can be cited as $L_{61}$.

$Y_{61}$, $y_{71}$ and $Y_{81}$, as has already been described, represent an anionic group or a nonionic group the lone pair of which forms a hydrogen bond with the hydrogen atom of the hydrazine to form a 5- to 7-membered ring. More specifically, carboxylic acid, sulfonic acid, sulfinic acid, phosphoric acid, phosphonic acid and the salts of these acids can be cited as such an anionic group. Examples of the salts include an alkali metal ion (e.g., sodium, potassium), an alkaline earth metal ion (e.g., calcium, magnesium), ammonium (e.g., ammonium, triethylammonium), tetrabutylammonium, pyridinium), and phosphonium (tetraphenylphosphonium). The nonionic group is a group which has at least one oxygen, nitrogen, sulfur or phosphorus atom, e.g., an alkoxyl group, an amino group, an alkylthio group, a carbonyl group, a carbamoyl group, an alkoxycarbonyl group, a urethane group, a ureido group, an acyloxy group or an acylamino group can be cited. $Y_{61}$, $Y_{71}$ and $Y_{81}$ preferably represent an anionic group, more preferably a carboxylic acid and the salt thereof.

As the group capable of substitution on a benzene ring of $X_{81}$ and preferred substituents thereof, the substituents described for $R_{61}$ in formula (III) can be applied to. When $m_{81}$ is 2 or more, each $X_{81}$ may be the same or different.

$R_{61}$, $R_{71}$, $R_{81}$ and $X_{81}$ may contain a nondiffusible group used in photographic couplers or may contain a group which accelerates adsorption onto silver halide. A nondiffusible group is a group having from 8 to 30, preferably from 12 to 25, carbon atoms. A group which accelerates adsorption onto silver halide is preferably thioamidos (e.g., thiourethane, thioureido, thioamido), mercaptos (e.g., heterocyclic mercapto such as 5-mercaptotetrazole, 3-mercapto-1,2,4-triazole, 2-mercapto-1,3,4-thiadiazole, and 2-mercapto-1,3,4-oxadiazole, alkylmercapto, arylmercapto) and 5- or 6-membered nitrogen-containing heterocyclic rings which form imino silvers (e.g., benzotriazole). Those having a group which accelerates adsorption onto silver halide may have such a structure that the adsorptive group is protected, the protective group is removed at the time of development processing and the adsorption to silver halide is accelerated.

In formulae (III), (IV) and (V), radicals obtained by eliminating hydrogen atoms from each two compounds may be bonded to form a bis-type compound.

In formulae (III), (IV) and (V), formulae (III) and (IV) are preferred, and formula (III) is more preferred. Further, formulae (III), (IV) and (V) are more preferably represented by formulae (IX), (X) and (XI), and most preferably represented by formula (IX).

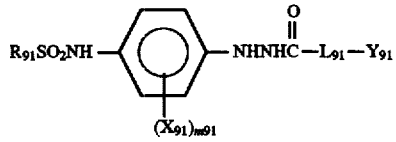

(IX)

wherein $R_{91}$, $X_{91}$ and $m_{91}$ each has the same meaning as $R_{81}$, $X_{81}$ and $m_{81}$ in formula (V), and $L_{91}$ and $Y_{91}$ each has the same meaning as $L_{61}$ and $Y_{61}$ in formula (III).

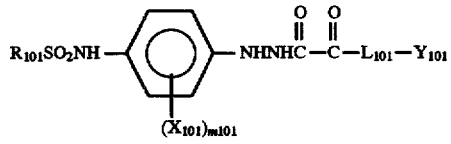

(X)

wherein $R_{101}$, $X_{101}$ and $m_{101}$ each has the same meaning as $R_{81}$, $X_{91}$ and $m_{81}$ in formula (V), and $L_{101}$ and $Y_{101}$ each has the same meaning as $L_{61}$ and $Y_{61}$ in formula (IV).

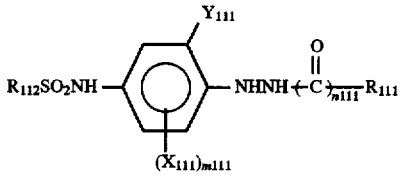
(XI)
wherein $R_{111}$, $R_{112}$, $X_{111}$, $Y_{111}$, $m_{111}$ and $n_{111}$ each has the same meaning as $R_{81}$, $R_{81}$, $X_{81}$, $Y_{81}$, $m_{81}$ and $n_{81}$ in formula (V).
Specific examples of the hydrazine derivatives for use in the present invention are shown below, but the present invention is not limited thereto.
V-1
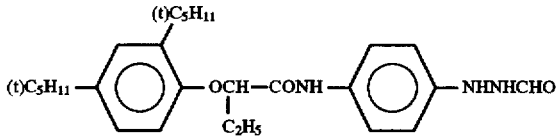
V-2
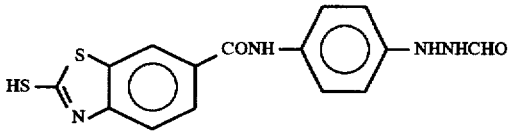
V-3
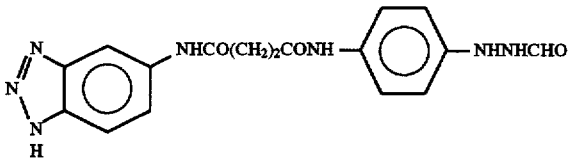
V-4
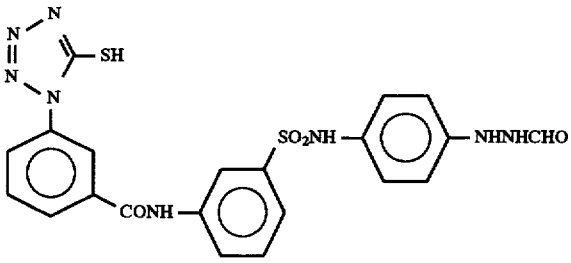
V-5
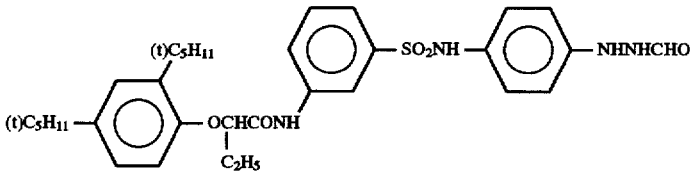
V-6
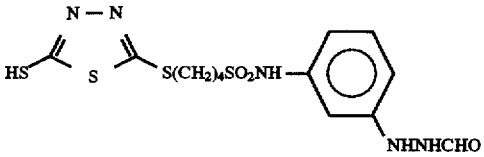
V-7
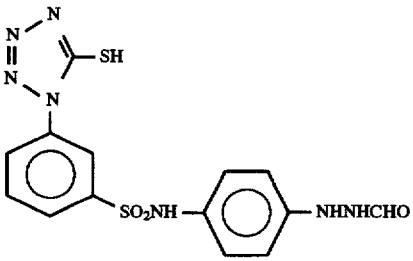

-continued
V-8
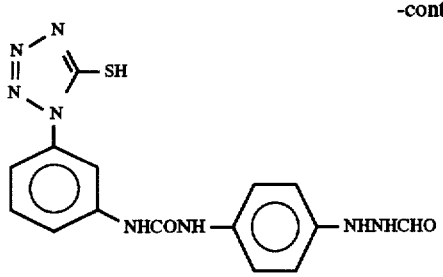
V-9
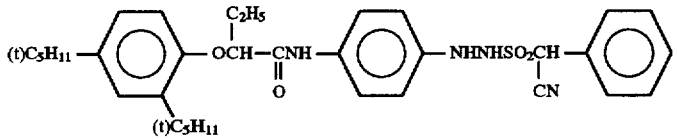
V-10
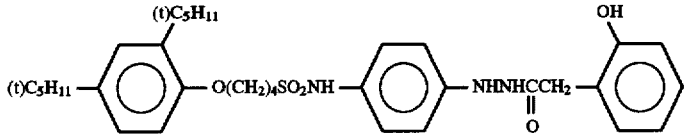
V-11
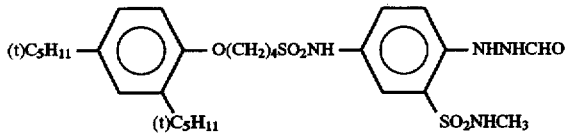
V-12
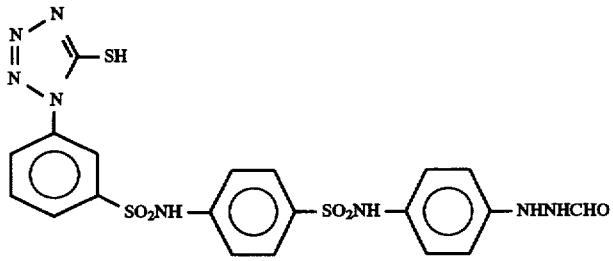
V-13
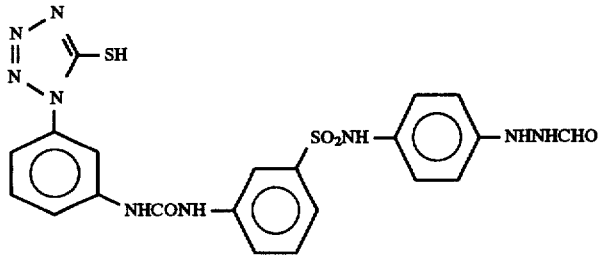
V-14
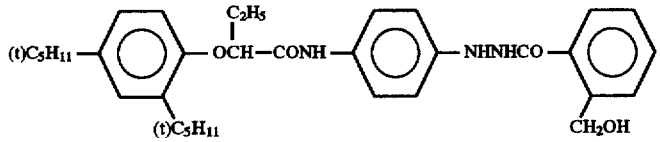
V-15
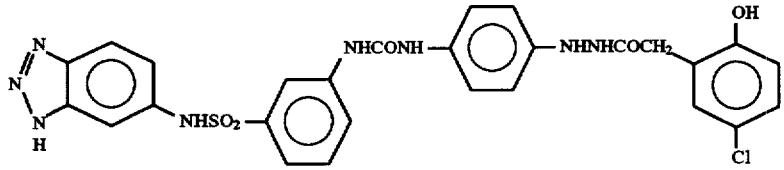
V-16
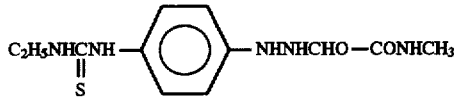

-continued
V-17
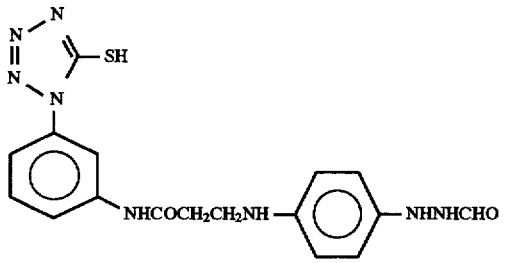
V-18
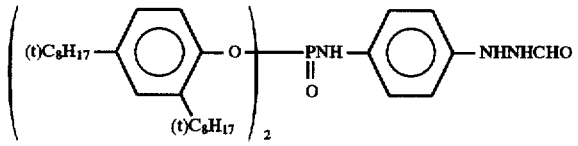
V-19
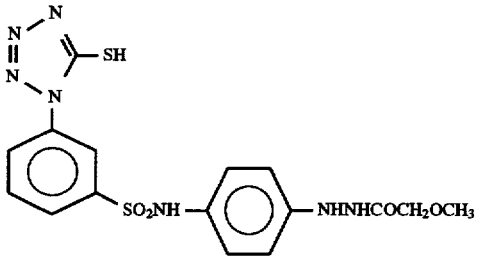
V-20
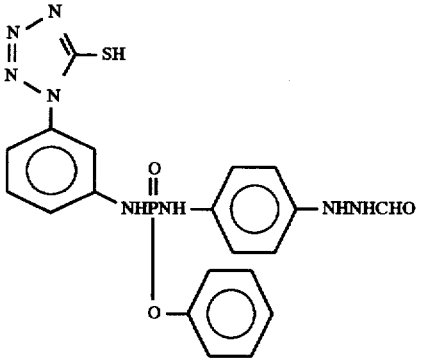
V-21
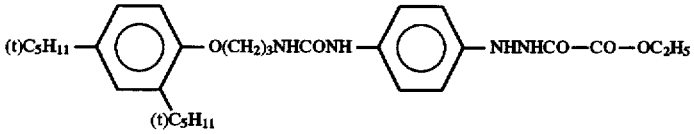
V-22
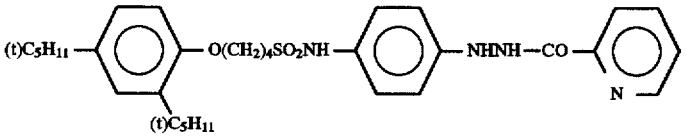
V-23
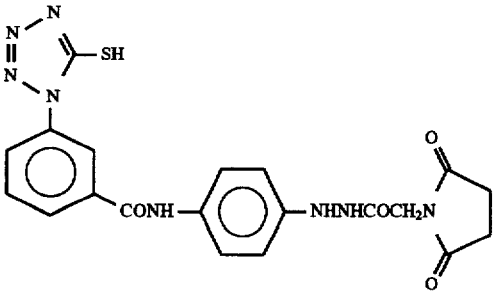

-continued
V-24
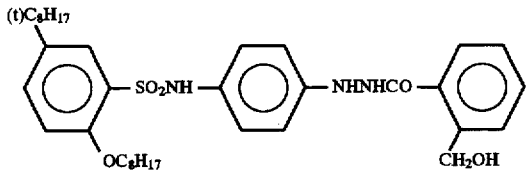
V-25
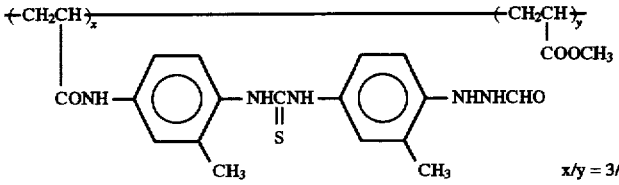
x/y = 3/97 (by mole)
average molecular weight:
about 100,000
V-26
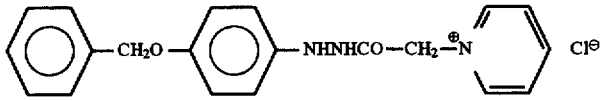
V-27
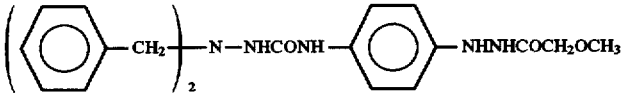
V-28
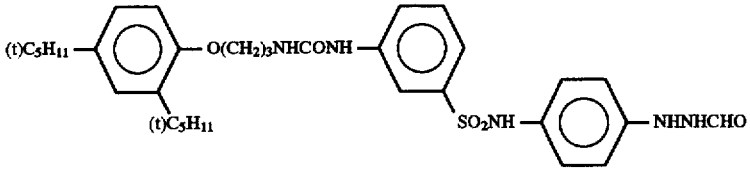
V-29
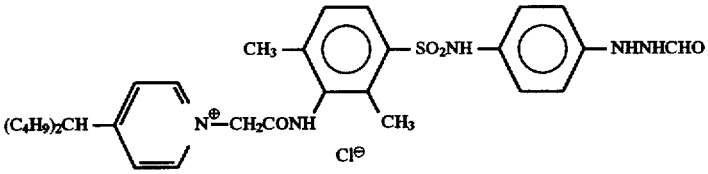
V-30
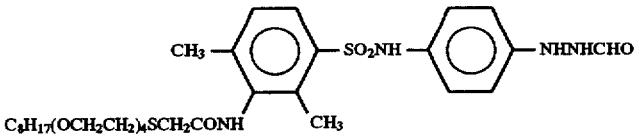
V-31
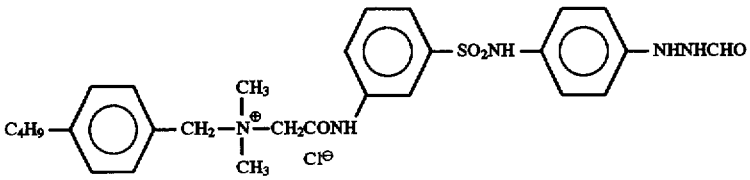
V-32
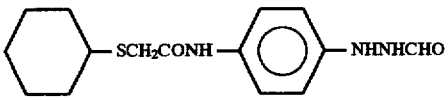

-continued
V-33
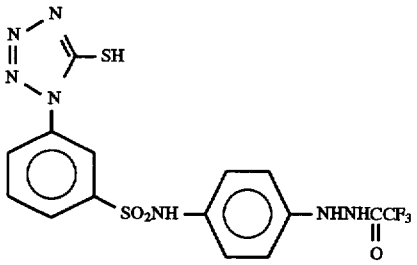
V-34
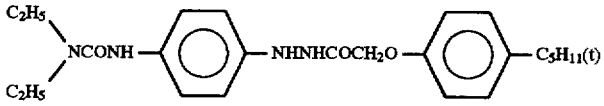
V-35
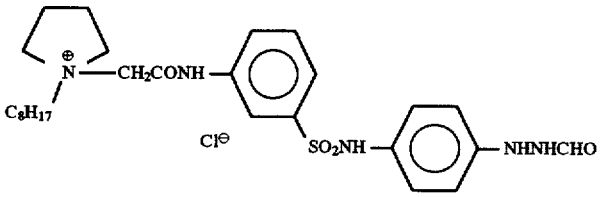
V-36
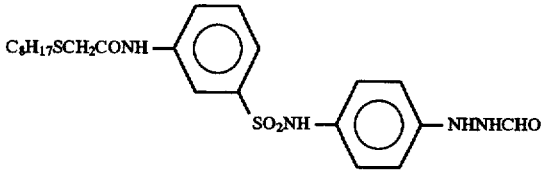
V-37
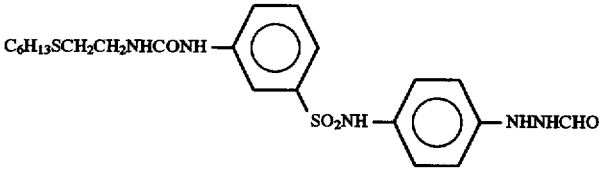
V-38
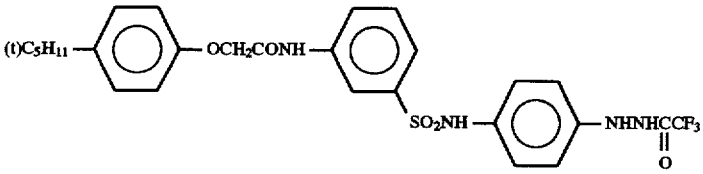
V-39
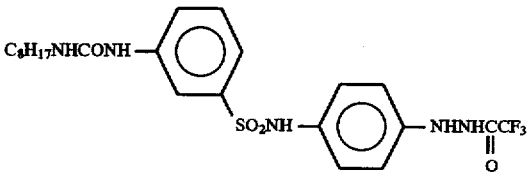
V-40
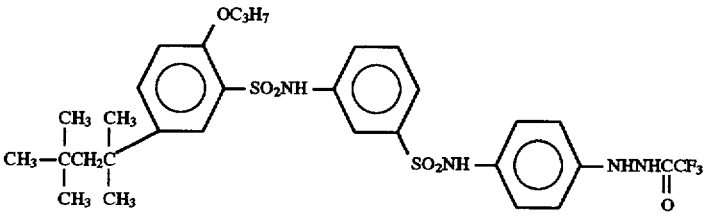

-continued
V-41
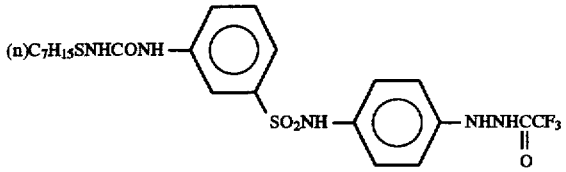
V-42
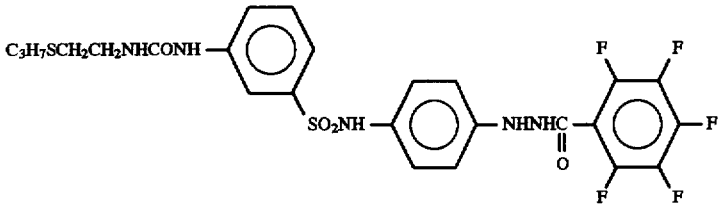
V-43
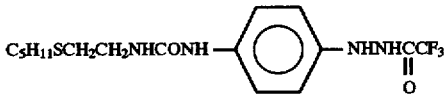
V-44
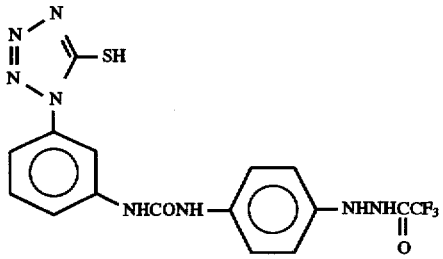
V-45
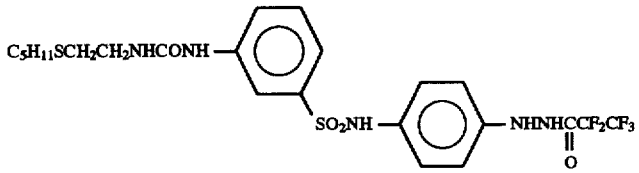
V-46
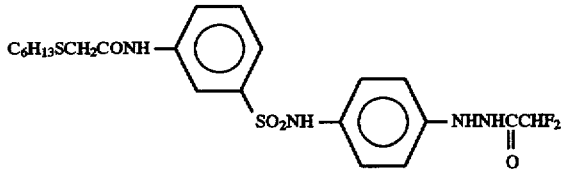
V-47
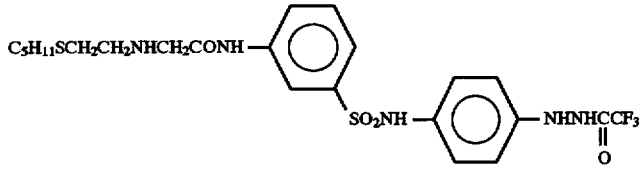
V-48
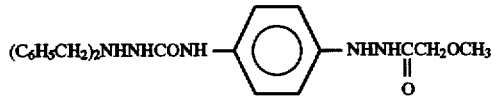
V-49
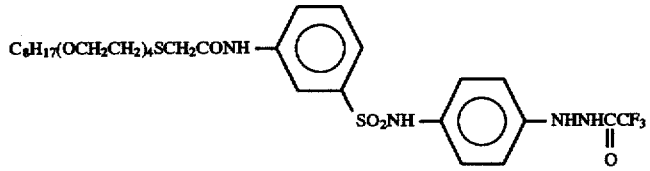

-continued
V-50
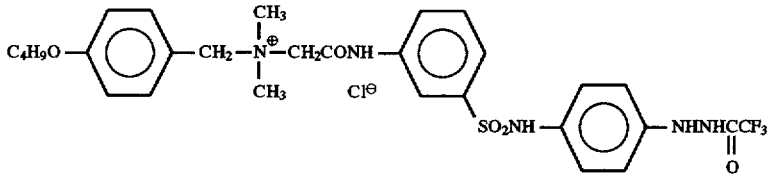
V-51
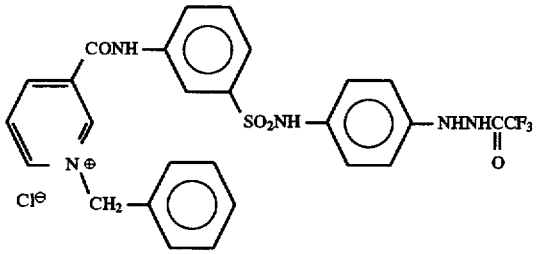
V-52
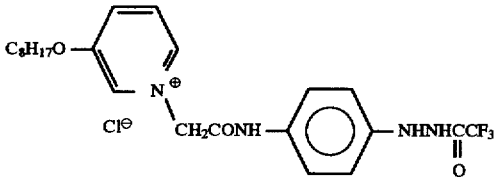
V-53
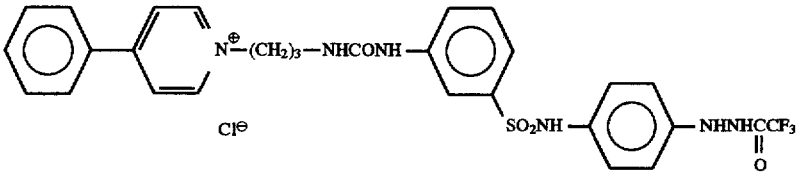
V-54
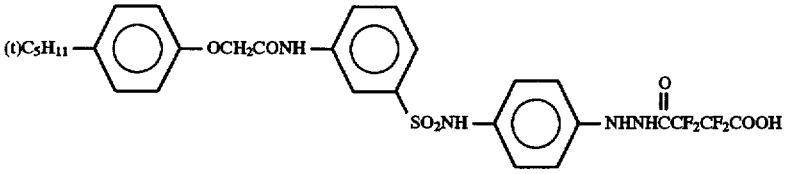
V-55
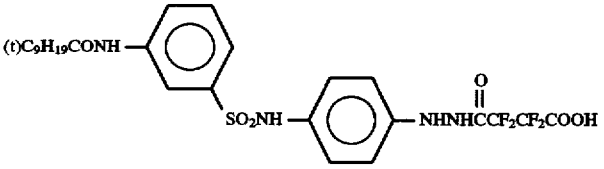
V-56
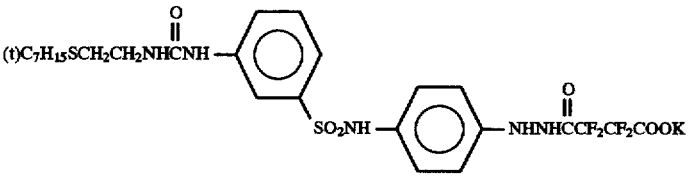
V-57
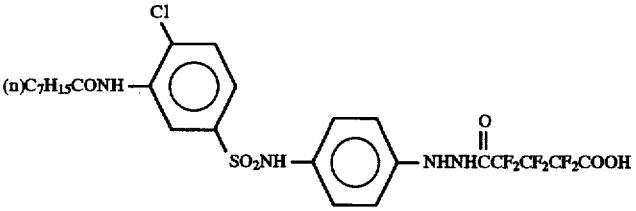

-continued
V-58
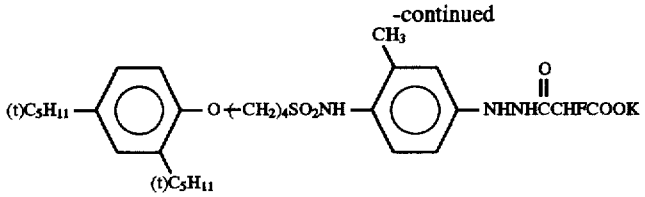
V-59
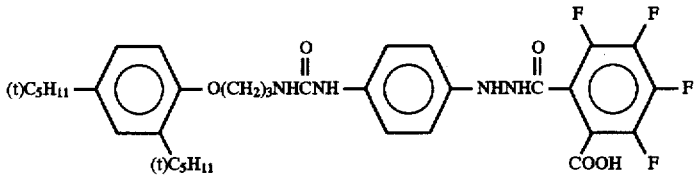
V-60
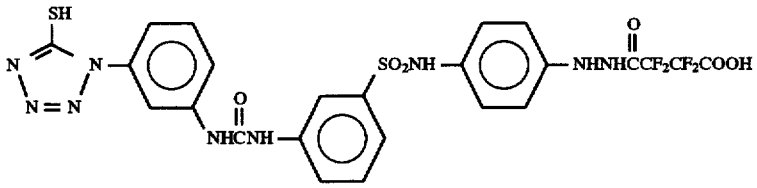
V-61
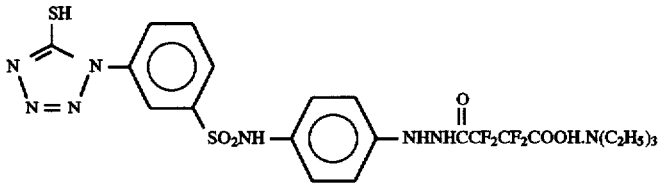
V-62
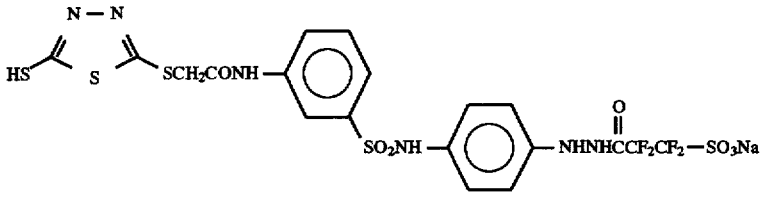
V-63
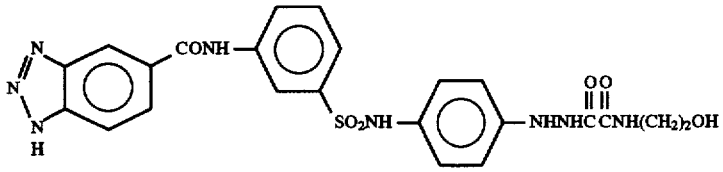
V-64
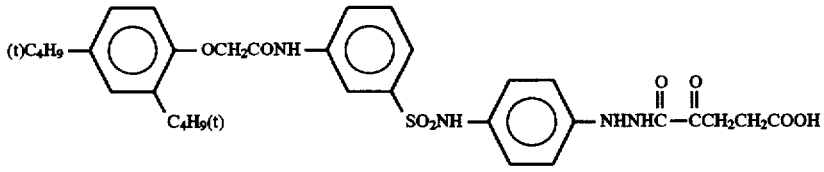
V-65
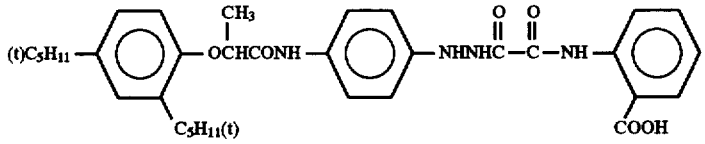
V-66
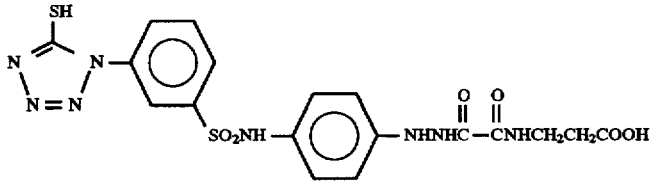

-continued
V-67
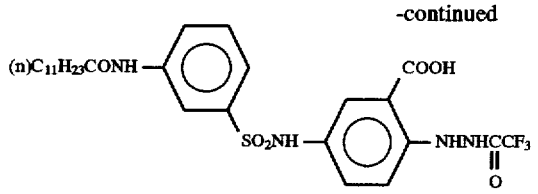
V-68
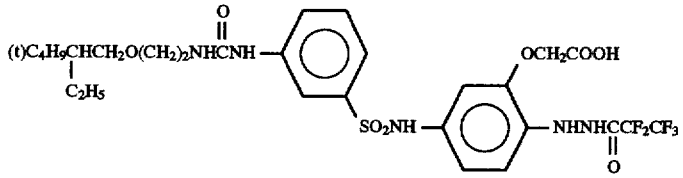
V-69
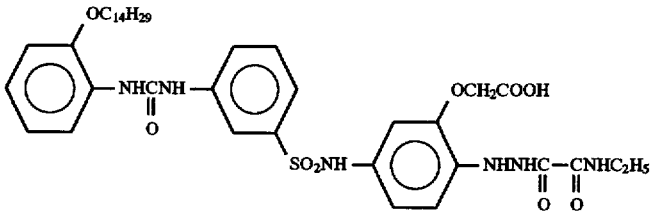
V-70
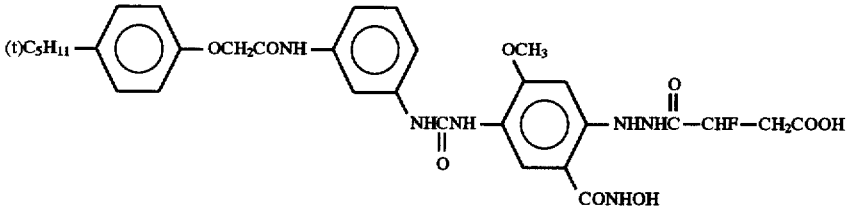
V-71
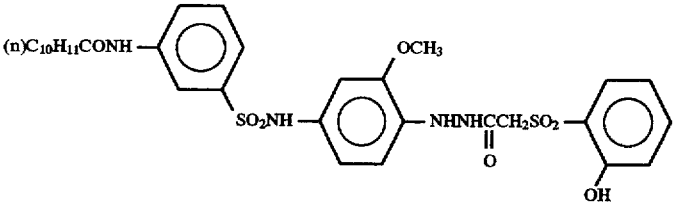
V-72
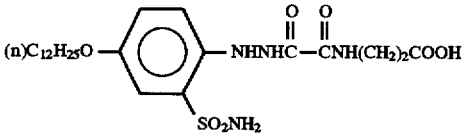
V-73
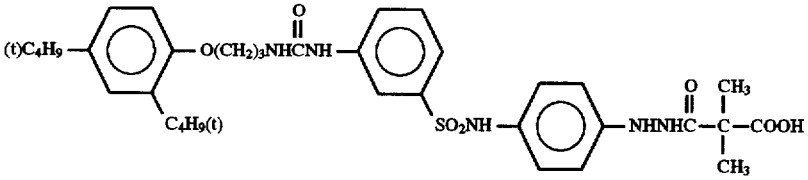
V-74
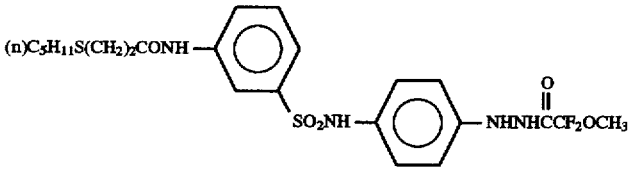
V-75
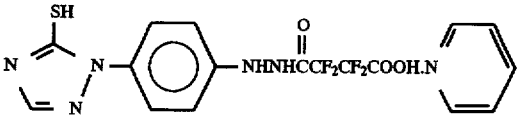

-continued
V-76
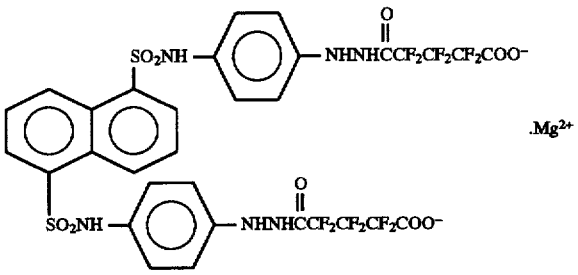
V-77
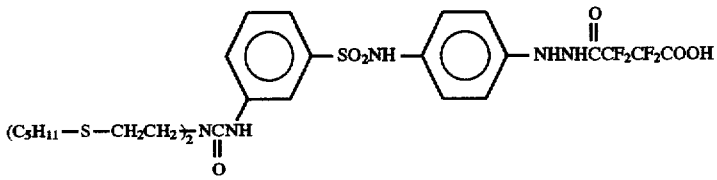
V-78
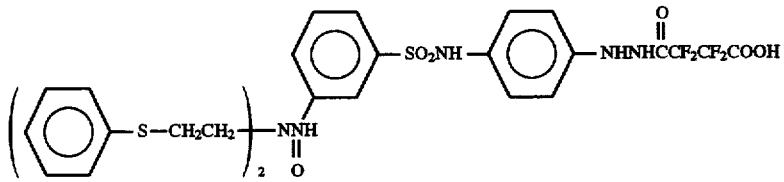
V-79
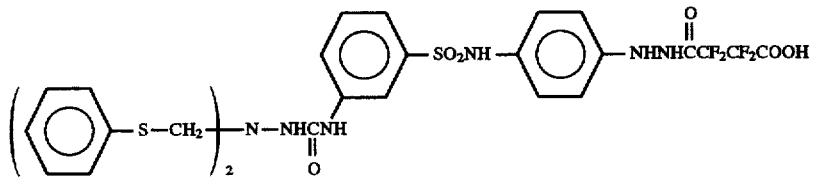
V-80
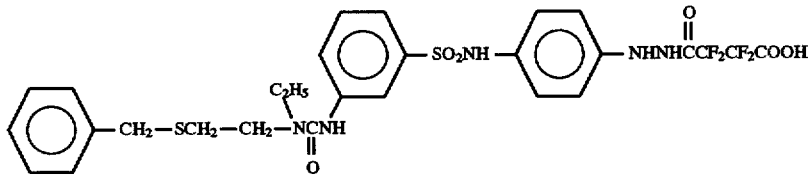
V-81
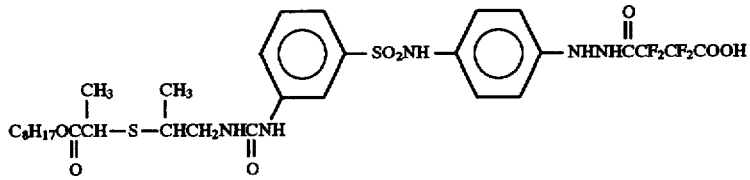
V-82
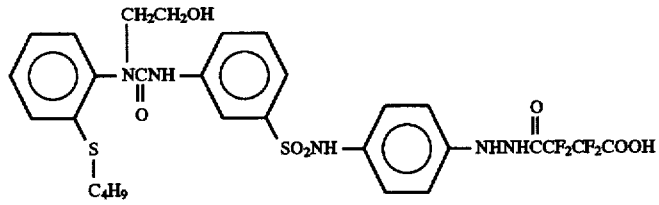
V-83
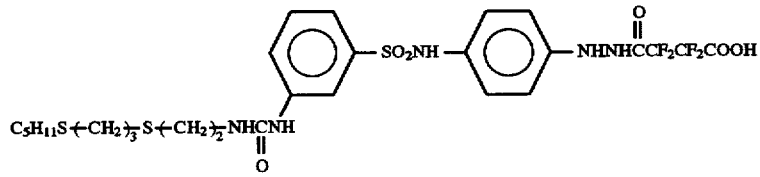

-continued

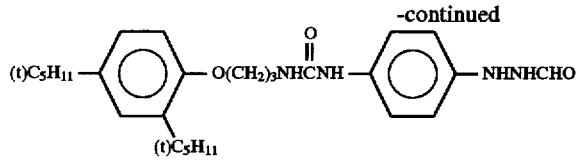

V-84

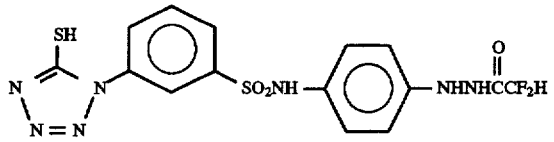

V-85

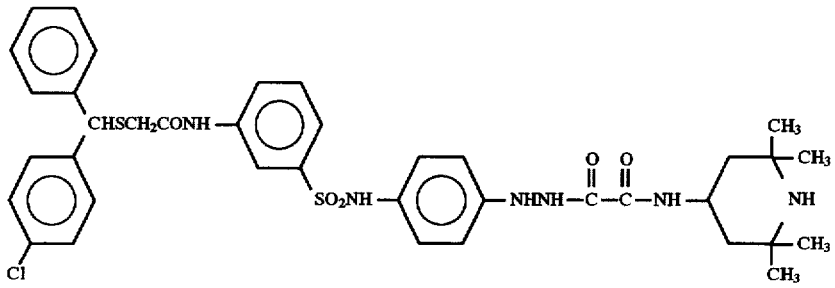

V-86

As the hydrazine derivatives which can be used in the present invention, in addition to the compounds shown above, those disclosed in *Research Disclosure*, Item 23516 (November, 1983, p. 346) and the literature cited therein, U.S. Pat. Nos. 4,080,207, 4,269,929, 4,276,364, 4,278,748, 4,385,108, 4,459,347, 4,478,928, 4,560,638, 4,686,167, 4,912,016, 4,988,604, 4,994,365, 5,041,355, 5,104,769, British Patent 2,011,391B, European Patent 217310, European Patent 301799, European Patent 356898, JP-A-60-179734, JP-A-61-170733, JP-A-61-270744, JP-A-62-178246, JP-A-62-270948, JP-A-63-29751, JP-A-63-32538, JP-A-63-104047, JP-A-63-121838, JP-A-63-129337, JP-A-63-223744, JP-A-63-234244, JP-A-63-234245, JP-A-63-234246, JP-A-63-294552, JP-A-63-306438, JP-A-64-10233, JP-A-1-90439, JP-A-1-100530, JP-A-1-105941, JP-A-1-105943, JP-A-1-276128, JP-A-1-280747, JP-A-1-283548, JP-A-1-283549, JP-A-1-285940, JP-A-2-2541, JP-A-2-77057, JP-A-2-139538, JP-A-2-196234, JP-A-2-196235, JP-A-2-198440, JP-A-2-198441, JP-A-2-198442, JP-A-2-220042, JP-A-2-221953, JP-A-2-221954, JP-A-2-285342, JP-A-2-285343, JP-A-2-289843, JP-A-2-302750, JP-A-2-304550, JP-A-3-37642, JP-A-3-54549, JP-A-3-125134, JP-A-3-184039, JP-A-3-240036, JP-A-3-240037, JP-A-3-259240, JP-A-3-280038, JP-A-3-282536, JP-A-4-51143, JP-A-4-56842, JP-A-4-84134, JP-A-2-230233, JP-A-4-96053, JP-A-4-216544, JP-A-5-45761, JP-A-5-45762, JP-A-5-45763, JP-A-5-45764, JP-A-5-45765, and JP-A-6-289524 can be cited.

The amount of hydrazine derivatives for use in the present invention is preferably from $1\times10^{-6}$ mol to $5\times10^{-2}$ mol, and particularly preferably from $1\times10^{-5}$ mol to $2\times10^{-2}$ mol, per mol of the silver halide.

The hydrazine derivatives of the present invention can be used in the form of a solution in an appropriate organic solvent miscible with water, such as alcohols (e.g., methanol, ethanol, propanol, fluorinated alcohol), ketones (e.g., acetone, methyl ethyl ketone), dimethylformamide, dimethyl sulfoxide, and methyl cellosolve.

Further, the hydrazine derivatives for use in the present invention can also be used in the form of an emulsion dispersion mechanically prepared according to well known emulsifying dispersion methods by dissolving using oils such as dibutyl phthalate, tricresyl phosphate, glyceryl triacetate and diethyl phthalate, or auxiliary solvents such as ethyl acetate and cyclohexanone, or they can be used in the form of a dispersion prepared according to a solid dispersion method in which powders of hydrazine derivatives are dispersed in water using a ball mill, a colloid mill or ultrasonic wave.

Further, they can also be used incorporated in polymer fine grains as disclosed in JP-A-2-948.

A nucleation accelerating agent such as amine derivatives, onium salts, disulfide derivatives and a hydroxymethyl derivatives can preferably be contained in silver halide emulsion layers or other hydrophilic colloid layers of the silver halide photographic material according to the present invention.

As amine derivatives for use in the present invention, the compounds disclosed, for example, in JP-A-60-140340, JP-A-62-50829, JP-A-62-222241, JP-A-62-250439, JP-A-62-280733, JP-A-63-124045, JP-A-63-133145 and JP-A-63-286840 can be cited. The compounds having groups which are adsorbed onto silver halide as disclosed in JP-A-63-124045, JP-A-63-133145 and JP-A-63-286840, and the compounds the total carbon atoms of which are 20 or more as disclosed in JP-A-62-222241 are more preferably used as amine derivatives.

Ammonium salts or phosphonium salts are preferably used as an onium salt for use in the present invention. Preferred examples of ammonium salts include the compounds disclosed in JP-A-62-250439 and JP-A-62-280733. Also, as preferred examples of phosphonium salts, the compounds disclosed in JP-A-61-167939 and JP-A-62-280733 can be cited.

As the disulfide derivatives for use in the present invention, the compounds disclosed in JP-A-61-198147 can be cited, for example.

The compounds disclosed in U.S. Pat. Nos. 4,693,956, 4,777,118, European Patent 231850 and JP-A-62-50829 can be preferably used as a hydroxymethyl derivative in the present invention, diarylmethanol derivatives are more preferably used.

There can be cited, as particularly useful nucleation accelerating agents, the compounds represented by formulae (VI) to (VIII), specifically, exemplified compounds IV-1 to IV-36, V-1 to V-22, VI-1 to VI-36 and VIII-1 to VIII-41 disclosed in JP-A-7-287338, and the compounds represented by formulae (A) to (D), specifically, exemplified compounds A-101 to A-147 and A-201 to A-255 disclosed in JP-A-7-287338. Specific examples of nucleation accelerating agents for use in the present invention are shown below, but the present invention is not limited thereto.

A-1)

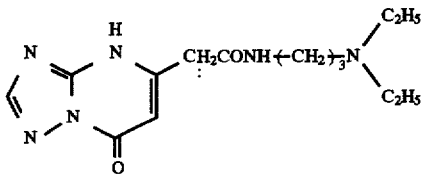

A-2)

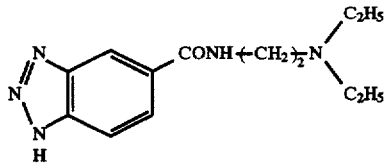

A-3)

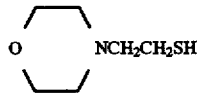

A-4)

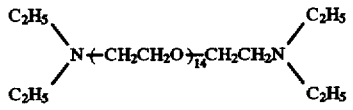

A-5)

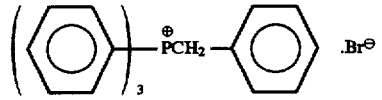

A-6)

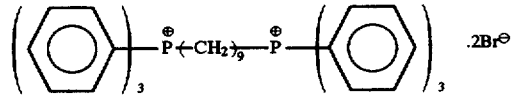

A-7)

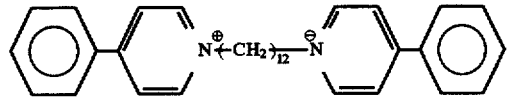

A-8)

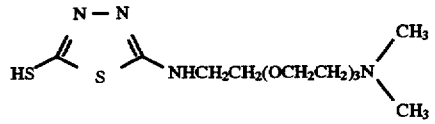

-continued

A-9)

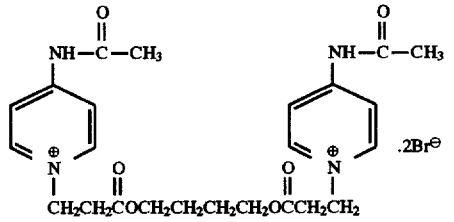

A-10)

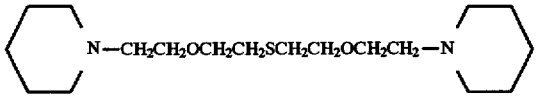

The optimal addition amounts of these compounds vary according to their kinds, but they are preferably used in an amount of from $1.0\times10^{-2}$ mol to $1.0\times10^{2}$ mol per mol of the hydrazine compound.

These compounds are dissolved in an appropriate solvent ($H_2O$, alcohols such as methanol and ethanol, acetone, dimethylformamide, methyl cellosolve) and added to a coating solution. These compounds may be used in combination of two or more kinds.

The silver halide in the silver halide emulsion for use in the silver halide photographic material according to the present invention is not particularly limited and any of silver chloride, silver chlorobromide, silver bromide, silver iodochlorobromide or silver iodobromide can be used but is preferably silver chlorobromide or silver iodochlorobromide having a silver chloride content of 50 mol % or more. A silver iodide content is preferably 3 mol % or less, more preferably 0.5 mol % or less. The form of the silver halide grain may be any of a cubic, tetradecahedral, octahedral, amorphous or plate-like form, but a cubic form is preferred. The average grain size of silver halide grains is preferably from 0.1 μm to 0.7 μm, and more preferably from 0.2 μm to 0.5 μm. With respect to the grain size distribution, grains having a narrow grain size distribution such that the variation coefficient represented by the equation [(standard deviation of the grain sizes)/(average grain size)]×100 is preferably 15% or less, more preferably 10% or less, are preferred.

The interior and the surface layer of the silver halide grains may comprise a uniform layer or different layers.

The photographic emulsions which are used in the present invention can be prepared according to the methods disclosed in P. Glafkides, *Chimie et Physique Photographique*, Paul Montel (1967), G. F. Duffin, *Photographic Emulsion Chemistry*, The Focal Press (1966), and V. L. Zelikman et al., *Making and Coating Photographic Emulsion*, The Focal Press (1964) and so on.

Any of a single jet method, a double jet method and a combination of these methods can be used for the reaction of a soluble silver salt with a soluble halogen salt.

A method in which grains are formed in the presence of excess silver ion (a so-called reverse mixing method) can also be used. A method in which the pAg in the liquid phase in which the silver halide is formed is kept constant, that is, the controlled double jet method, can also be used as one type of the double jet method. In addition, the grain formation is preferably carried out using silver halide solvents such as ammonia, thioether, or tetra-substituted thiourea. More preferred are tetra-substituted thiourea compounds and they are disclosed in JP-A-53-82408 and JP-A-55-77737. Preferred thiourea compounds are tetramethylthiourea and 1,3-dimethyl-2-imidazolidinethione.

Silver halide emulsions with a regular crystal form and a narrow grain size distribution can easily be obtained by the controlled double jet method and the grain formation method using silver halide solvents, which is effective to prepare the silver halide emulsion for use in the present invention.

Moreover, the method in which the rates of addition of the silver nitrate and the alkali halide are varied according to the grain growth rate as disclosed in British Patent 1,535,016, JP-B-48-36890 and JP-B-52-16364, and the method in which the concentrations of the aqueous solutions are varied as disclosed in British Patent 4,242,445 and JP-A-55-158124 are preferably and effectively used to rapidly grow grains within the range not exceeding the critical degree of saturation in order to provide uniform grain size.

It is preferred to contain at least one kind of a metal selected from the group consisting of rhodium, rhenium, ruthenium, osmium and iridium in silver halide grains for use in the silver halide photographic material of the present invention to attain high contrast and low fog generation. The content thereof is preferably from $1\times10^{-9}$ mol to $1\times10^{-5}$ mol, more preferably from $1\times10^{-8}$ mol to $5\times10^{-6}$ mol, per mol of the silver. These metals can be used in combination of two or more. These metals can be included in silver halide grains uniformly or may be distributed locally in grain as disclosed in JP-A-63-29603, JP-A-2-306236, JP-A-3-167545, JP-A-4-76534 and JP-A-6-110146.

Water-soluble rhodium compounds can be used as a rhodium compound in the present invention, for example, rhodium(III) halide compounds, or rhodium complex salts having halogen, amines, or oxalato as a ligand, such as hexachlororhodium(III) complex salts, hexabromorhodium (III) complex salts, hexaamminerhodium(III) complex salts, trioxalatorhodium(III) complex salts and the like. These rhodium compounds are dissolved in water or an appropriate solvent and used. A conventional method such as a method in which an aqueous solution of hydrogen halide (e.g., hydrochloric acid, hydrobromic acid, hydrofluoric acid) or alkali halide (e.g., KCl, NaCl, KBr, NaBr) is added to stabilize the solution of rhodium compound can be used. It is also possible to include and dissolve other silver halide grains which have been previously doped with rhodium during the preparation of silver halide instead of using water-soluble rhodium.

The addition amount of these rhodium compounds is preferably from $1\times10^{-8}$ mol to $5\times10^{-6}$ mol, and particularly preferably from $5\times10^{-8}$ mol to $1\times10^{-6}$ mol, per mol of the silver halide.

These compounds can be added optionally during the preparation of silver halide emulsion grains and at any stage prior to coating of the emulsion, but they are particularly preferably added during emulsion formation and incorporated into the silver halide grains.

Rhenium, ruthenium, and osmium for use in the present invention are added in the form of water-soluble complex salts as disclosed in JP-A-63-2042, JP-A-1-285941, JP-A-2-20852 and JP-A-2-20855. Particularly preferred compounds are complexes having six ligands represented by the following formula:

$$[ML_6]^{n-}$$

wherein M represents Ru, Re or Os, and n represents 0, 1, 2, 3 or 4. In this case, counter ions are not important and ammonium or alkali metal ions are used.

Examples of preferred ligands include a halide ligand, a cyanide ligand, a carbonyl ligand, an oxo ligand, a nitrosyl ligand, and a thionitrosyl ligand. Specific examples of complexes for use in the present invention are shown below but the present invention is not limited thereto.

| | | |
|---|---|---|
| $[ReCl_6]^{3-}$ | $[ReBr_6]^{3-}$ | $[ReCl_5(NO)]^{2-}$ |
| $[Re(NS)Br_5]^{2-}$ | $[Re(NO)(CN)_5]^{2-}$ | $[Re(O)_2(CN)_4]^{3-}$ |
| $[RuCl_6]^{3-}$ | $[RuCl_4(H_2O)_2]^{1-}$ | $[RuCl_5(NO)]^{2-}$ |
| $[RuBr_5(NS)]^{2-}$ | $[Ru(CN)_6]^{4-}$ | $[Ru(CO)_3Cl_3]^{2-}$ |
| $[Ru(CO)Cl_5]^{2-}$ | $[Ru(CO)Br_5]^{2-}$ | |
| $[OsCl_6]^{3-}$ | $[OsCl_5(NO)]^{2-}$ | $[Os(NO)(CN)_5]^{2-}$ |
| $[Os(NS)Br_5]^{2-}$ | $[Os(CN)_6]^{4-}$ | $[Os(O)_2(CN)_4]^{4-}$ |

The addition amount of these compounds is preferably from $1\times10^{-9}$ mol to $1\times10^{-5}$ mol, and particularly preferably from $1\times10^{-8}$ mol to $1\times10^{-6}$ mol, per mol of the silver halide.

These compounds can be added optionally during the preparation of silver halide emulsion grains and at any stage prior to coating of the emulsion, but they are particularly preferably added during emulsion formation and incorporated into the silver halide grains.

Various methods can be used for the addition of these compounds during grain formation of silver halide and incorporating them into silver halide grains, for example, a method in which a metal complex powder per se or an aqueous solution dissolved therein a metal complex powder with NaCl and KCl is previously added to a solution of water-soluble salt or water-soluble halide for grain formation, a method in which a metal complex powder is simultaneously added as the third solution when a solution of silver salt and a solution of halide are mixed to prepare silver halide grains by a triple jet method by three solutions, or a method in which a necessary amount of an aqueous solution of a metal complex powder is added to a reaction vessel during grain formation. A method of adding a metal complex powder per se or an aqueous solution dissolved therein a metal complex powder with NaCl and KCl is added to a water-soluble halide solution is particularly preferred.

When these compounds are added to surfaces of grains, a necessary amount of an aqueous solution of metal complexes can be added to a reaction vessel immediately after grain formation, during or at the time of finishing of physical ripening, or during chemical ripening.

Various iridium compounds can be used in the present invention, for example, hexachloroiridium, hexaammineiridium, trioxalatoiridium, hexacyanoiridium and the like. These iridium compounds are dissolved in water or an appropriate solvent and used. A conventional method such as a method in which an aqueous solution of hydrogen halide (e.g., hydrochloric acid, hydrobromic acid, hydrofluoric acid) or alkali halide (e.g., KCl, NaCl, KBr, NaBr) is added to stabilize the solution of iridium compound can be used. It is also possible to include and dissolve other silver halide grains which have been previously doped with iridium during the preparation of silver halide instead of using water-soluble iridium.

The silver halide grains according to the present invention may be doped with other heavy metal salts. In particular, doping with Fe salts, such as $K_4[Fe(CN)_6]$, is advantageous.

Further, the silver halide grains for use in the present invention may contain metal atoms such as cobalt, nickel, palladium, platinum, gold, thallium, copper, lead or chromium. The preferred addition amount of these metals is from $1\times10^{-9}$ to $1\times10^{-4}$ mol per mol of the silver halide. Further, these metals can be added as a metal salt in the form of a single salt, a double salt or a complex salt during the preparation of grains.

The silver halide emulsion of the present invention is preferably chemically sensitized. Conventionally known chemical sensitization methods such as sulfur sensitization, selenium sensitization, tellurium sensitization and noble metal sensitization can be used alone or in combination. When sensitization is conducted in combination, a combination of sulfur sensitization and gold sensitization, a combination of sulfur sensitization, selenium sensitization and gold sensitization, and a combination of sulfur sensitization, tellurium sensitization and gold sensitization are preferred, for example.

The sulfur sensitization for use in the present invention is usually carried out by adding a sulfur sensitizer and stirring the emulsion at high temperature of 40° C. or more for a certain period of time. Various known sulfur compounds can be used as a sulfur sensitizer, for example, in addition to sulfur compounds contained in gelatin, various sulfur compounds, e.g., thiosulfates, thioureas, thiazoles, and rhodanines. Preferred sulfur compounds are thiosulfates and thioureas. The addition amount of a sulfur sensitizer is varied in accordance with various conditions such as the pH and temperature during chemical ripening and the grain size of the silver halide grains, but is preferably from $10^{-7}$ to $10^{-2}$ mol and more preferably from $10^{-5}$ to $10^{-3}$ mol, per mol of the silver halide.

Various known selenium compounds can be used as a selenium sensitizer in the present invention. The selenium sensitization is usually carried out by adding unstable and/or non-unstable selenium compounds and stirring the emulsion at high temperature, preferably 40° C. or more, for a certain period of time. The compounds disclosed in JP-B-44-15748, JP-B-43-13489, JP-A-4-25832, JP-A-4-109240 and JP-A-4-324855 can be used as unstable selenium compounds. The compounds represented by formulae (VIII) and (IX) disclosed in JP-A-4-324855 are particularly preferably used.

The tellurium sensitizer for use in the present invention is a compound which forms silver telluride in the surfaces or interiors of silver halide grains which silver telluride is presumed to become sensitization speck. The formation rate of the silver telluride in the silver halide emulsion can be examined according to the method disclosed in JP-A-5-313284. Specific examples of tellurium sensitizers which can be used in the present invention are those disclosed in the following patents and literature: U.S. Pat. Nos. 1,623,499, 3,320,069, 3,772,031, British Patents 235,211, 1,121,496, 1,295,462, 1,396,696, Canadian Patent 800,958, JP-A-4-204640, JP-A-4-271341, JP-A-4-333043, JP-A-5-303157, *J. Chem. Soc. Chem. Commun.*, 635 (1980), ibid., 1102 (1979), ibid., 645 (1979), *J. Chem. Soc. Perkin. Trans.*, 1, 2191 (1980), S. Patai compiled, *The Chemistry of Organic Selenium and Tellurium Compounds*, Vol. 1 (1986), and ibid., Vol. 2 (1987). The compounds represented by formulae (II), (III) and (IV) disclosed in JP-A-5-313284 are particularly preferred.

The amount of the selenium and tellurium sensitizers to be used in the present invention varies according to the silver halide grains used and the conditions of chemical ripening, but is generally about $10^{-8}$ to $10^{-2}$ mol, preferably about $10^{-7}$ to $10^{-3}$ mol, per mol of the silver halide. There is no particular limitation on the conditions of chemical sensitization in the present invention, but pH is from 5 to 8, pAg is from 6 to 11, preferably from 7 to 10, and temperature is from 40° to 95° C., preferably from 45° to 85° C.

The noble metal sensitizers which are used in the present invention include gold, platinum and palladium, and gold sensitization is particularly preferred. Specific examples of the gold sensitizers for use in the present invention include chloroauric acid, potassium chloroaurate, potassium aurithiocyanate and gold sulfide, and the amount of about $10^{-7}$ to $10^{-2}$ mol per mol of the silver halide can be used.

Cadmium salt, sulfite, lead salt and thallium salt may be coexist in the silver halide emulsion for use in the present invention in the process of the formation or physical ripening of silver halide grains.

Reduction sensitization can be used in the present invention. As reduction sensitizers there may be used stannous salt, amines, formamidinesulfinic acid, and silane compounds.

Thiosulfonic acid compounds may be added to the silver halide emulsion of the present invention according to the method disclosed in European Patent 293917.

The silver halide emulsion in the photographic material of the present invention may be one kind, or two or more kinds of silver halide emulsions (for example, those differing in average grain sizes, differing in halogen compositions, differing in crystal habits, or differing in the conditions of chemical sensitization) may be used in combination.

Gelatin is advantageously used as a protective colloid for photographic emulsions or a binder for emulsion layers and other hydrophilic colloid layers, but other hydrophilic colloids can also be used. Examples thereof include proteins such as gelatin derivatives, graft polymers of gelatin and other high polymers, albumin and casein; sugar derivatives such as cellulose derivatives such as hydroxyethyl cellulose, carboxymethyl cellulose, and cellulose sulfate, sodium alginate, and starch derivatives; and various kinds of synthetic hydrophilic high polymers of homopolymers or copolymers such as polyvinyl alcohol, partially acetalated polyvinyl alcohol, poly-N-vinylpyrrolidone, polyacrylic acid, polymethacrylic acid, polyacrylamide, polyvinylimidazole, and polyvinylpyrazole.

Acid-processed gelatin can be used as well as lime-processed gelatin, and hydrolyzed product and enzyme decomposed product of gelatin can also be used.

The photographic material of the present invention can contain various compounds known as antifoggants and stabilizers for purposes of preventing fog or stabilizing photographic capabilities during manufacture, storage or photographic processing of the photographic material, for example, azoles, e.g., benzothiazolium salt, nitroindazoles, chlorobenzimidazoles, bromobenzimidazoles, mercaptothiazoles, mercaptobenzothiazoles, mercaptothiadiazoles, aminotriazoles, benzothiazoles, and nitrobenzotriazoles; mercaptopyrimidines; mercaptotriazines; thioketo compounds, e.g., oxazolinethione; azaindenes, e.g., triazaindenes, tetraazaindenes (in particular, 4-hydroxy-substituted(1,3,3a,7)tetraazaindenes), and pentaazaindenes; hydroquinone and derivatives thereof; disulfides, e.g., thioctic acid; benzenethiosulfonic acid, benzenesulfinic acid, and benzenesulfonic acid amide. Of the above, preferred compounds are benzotriazoles (e.g., 5-methylbenzotriazole) and nitroindazoles (e.g., 5-nitroindazole). These compounds may also be included in processing solutions.

There is no particular limitation on various additives for use in the present invention and, for example, those described in the following corresponding places can preferably be used.

| Item | Places |
|---|---|
| 1) Surfactant | line 7, right upper column, page 9 to line 7, right lower column, page 9 of JP-A-2-12236; and line 13, left lower column, page 2 to line 18, right lower column, page |

-continued

| Item | Places |
|---|---|
| | 4 of JP-A-2-18542 |
| 2) Antifoggant | line 19, right lower column, page 17 to line 4, right upper column, page 18 of JP-A-2-103536; lines 1 to 5, right lower column, page 18 of JP-A-2-103536; and the thiosulfinic acid compounds in JP-A-1-237538 |
| 3) Polymer latex | lines 12 to 20, left lower column, page 18 of JP-A-2-103536 |
| 4) Compound having acid radical | line 6, right lower column, page 18 to line 1, left upper column, page 19 of JP-A-2-103536 |
| 5) Matting agent, sliding agent and plasticizer | line 15, left upper column, page 19 to line 15, right upper column, page 19 of JP-A-2-103536 |
| 6) Hardening agent | lines 5 to 17, right upper column, page 18 of JP-A-2-103536 |
| 7) Dye | the dyes in lines 1 to 18, right lower column, page 17 of JP-A-2-103536; and the solid dyes in JP-A-2-294638 and JP-A-5-11382 |
| 8) Binder | lines 1 to 20, right lower column, page 3 of JP-A-2-18542; and the syndiotactic polystyrene support |
| 9) Black pepper inhibitor | The compounds in U.S. Pat. No. 4,956,257 and JP-A-1-118832 |
| 10) Monomethine compound | The compounds represented by formula (II) (particularly Compounds II-1 to II-26) in JP-A-2-287532 |
| 11) Dihydroxybenzenes | From left upper column, page 11 to left lower column, page 12 in JP-A-3-39948; and the compounds in EP-A-452772 |

The developing solution for development processing a photographic material in the present invention can contain various additives generally used (e.g., a developing agent, an alkali agent, a pH buffer, a preservative, a chelating agent). Any known method can be used in development processing and known developing solutions can be used in the present invention.

The developing agent for use in the developing solution of the present invention is not particularly limited, but it is preferred to contain dihydroxybenzenes or ascorbic acid derivatives and, further, from the point of developing capability, combination of dihydroxybenzenes with 1-phenyl-3-pyrazolidones, dihydroxybenzenes with p-aminophenols, ascorbic acid derivatives with 1-phenyl-3-pyrazolidones, or ascorbic acid derivatives with p-aminophenols is preferred.

Dihydroxybenzene developing agent for use in the present invention includes hydroquinone, chlorohydroquinone, isopropylhydroquinone, methylhydroquinone, and hydroquinonemonosulfonate, and hydroquinone is particularly preferred.

Ascorbic acid derivative developing agent for use in the present invention includes ascorbic acid, erythorbic acid which is a stereoisomer of ascorbic acid, and alkali metal salts thereof (sodium salt, potassium salt). 1-Phenyl-3-pyrazolidones or derivatives thereof as a developing agent for use in the present invention include 1-phenyl-3-pyrazolidone, 1-phenyl-4,4-dimethyl-3-pyrazolidone, and 1-phenyl-4-methyl-4-hydroxymethyl-3-pyrazolidone.

p-Aminophenol based developing agent for use in the present invention includes N-methyl-p-aminophenol, p-aminophenol, N-(B-hydroxyethyl)-p-aminophenol, and N-(4-hydroxyphenyl)glycine, and N-methyl-p-aminophenol is preferred.

Dihydroxybenzene developing agent is, in general, preferably used in an amount of from 0.05 to 0.8 mol/liter, and particularly preferably from 0.2 to 0.6 mol/liter. When dihydroxybenzenes are used in combination with 1-phenyl-3-pyrazolidones or p-aminophenols, the amount used of the former is preferably from 0.05 to 0.6 mol/liter, more preferably from 0.2 to 0.5 mol/liter, and the latter is 0.06 mol/liter or less, more preferably 0.03 mol/liter or less.

Ascorbic acid derivative developing agent is, in general, preferably used in an amount of from 0.05 to 0.8 mol/liter, particularly preferably from 0.2 to 0.6 mol/liter. Further, when ascorbic acid derivative is used in combination with 1-phenyl-3-pyrazolidones or p-aminophenols, the amount used of the former is preferably from 0.05 to 0.6 mol/liter, more preferably from 0.2 to 0.5 mol/liter, and the latter preferably from 0.06 mol/liter or less, more preferably 0.03 mol/liter or less.

Examples of the preservatives which can be used in the developing solution for use in the present invention include sodium sulfite, potassium sulfite, lithium sulfite, ammonium sulfite, sodium bisulfite, potassium metabisulfite, and sodium formaldehyde bisulfite. Preferred addition amount of the sulfite preservative is 0.20 mol/liter or more, particularly preferably 0.3 mol/liter or more, but as too much an amount causes silver contamination of the developing solution, the upper limit is preferably 1.2 mol/liter, particularly preferably from 0.35 to 0.7 mol/liter.

A small amount of ascorbic acid derivatives may be used in combination with sulfite as a preservative for dihydroxybenzene based developing agent. As ascorbic acid derivatives, there are ascorbic acid, erythorbic acid which is a stereoisomer of ascorbic acid, and alkali metal salts thereof (sodium salt, potassium salt). The use of sodium erythorbate is economically preferred. The addition amount thereof is preferably from 0.03 to 0.12, particularly preferably from 0.05 to 0.10, in molar ratio to dihydroxybenzene developing agent. When ascorbic acid derivatives are used as a preservative, it is preferred not to contain boron compounds in the developing solution.

As an alkali agent which is used for setting pH, water-soluble inorganic alkali metal salts generally used (e.g., sodium hydroxide, potassium hydroxide, sodium carbonate, potassium carbonate) can be used.

Additives which can be used in the present invention include, in addition to the above compounds, a development inhibitor such as sodium bromide and potassium bromide; an organic solvent such as ethylene glycol, diethylene glycol, triethylene glycol, and dimethylformamide; a development accelerator such as alkanolamine, e.g., diethanolamine and triethanolamine, imidazole or derivatives thereof; and an antifoggant or a black pepper inhibitor such as mercapto based compounds, indazole based compounds, benzotriazole based compounds and benzimidazole based compounds. Specific examples include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-[(2-mercapto-1,3,4-thiadiazol-2-yl)thio]butanesulfonate, 5-amino-1,3,4-thiadiazole-2-thiol, methylbenzotriazole, 5-methylbenzotriazole, and 2-mercaptobenzotriazole. The addition amount of these antifoggants is, in general, from 0.01 to 10 mmol, more preferably from 0.1 to 2 mmol, per liter of the developing solution.

Further, various kinds of organic and inorganic chelating agents can be used in combination in the developing solution of the present invention. Examples of inorganic chelating agents include sodium tetrapolyphosphate and sodium hexametaphosphate.

On the other hand, as organic chelating agents, organic carboxylic acid, aminopolycarboxylic acid, organic phosphonic acid, aminophosphonic acid, and organic phosphonocarboxylic acid can be primarily used.

Examples of organic carboxylic acids include acrylic acid, oxalic acid, malonic acid, succinic acid, glutaric acid, adipic acid, pimelic acid, aci-elaidic acid, sebacic acid, nonanedicarboxylic acid, decanedicarboxylic acid, undecanedicarboxylic acid, maleic acid, itaconic acid, malic acid, citric acid, and tartaric acid, but organic carboxylic acids are not limited thereto.

Examples of aminopolycarboxylic acids include iminodiacetic acid, nitrilotriacetic acid, nitrilotripropionic acid, ethylenediaminemonohydroxyethyltriacetic acid, ethylenediaminetetraacetic acid, glycol ether tetraacetic acid, 1,2-diaminopropanetetraacetic acid, diethylenetriaminepentaacetic acid, triethylenetetraminehexaacetic acid, 1,3-diamino-2-propanoltetraacetic acid, glycol ether diaminetetraacetic acid, and the compounds disclosed in JP-A-52-25632, JP-A-55-67747, JP-A-57-102624, and JP-B-53-40900.

Examples of organic phosphonic acids include the hydroxyalkylidene-diphosphonic acids disclosed in U.S. Pat. Nos. 3,214,454, 3,794,591 and West German Patent Publication No. 2,227,639, and the compounds disclosed in *Research Disclosure*, Vol. 181, Item 18170 (May, 1979).

Examples of aminophosphonic acids include aminotris (methylenephosphonic acid), ethylenediaminetetramethylenephosphonic acid, aminotrimethylenephosphonic acid, and the compounds disclosed in *Research Disclosure*, No. 18170, JP-A-57-208554, JP-A-54-61125, JP-A-55-29883 and JP-A-56-97347.

Examples of organic phosphonocarboxylic acids include the compounds disclosed in JP-A-52-102726, JP-A-53-4 2730, JP-A-54-121127, JP-A-55-4024, JP-A-55-4025, JP-A-55-126241, JP-A-55-65955, JP-A-55-65956 and *Research Disclosure*, No. 18170.

These chelating agents may be used in the form of alkali metal salts or ammonium salts. The addition amount of these chelating agents is preferably from $1\times10^{-4}$ to $1\times10^{-1}$ mol, more preferably from $1\times10^{-3}$ to $1\times10^{-2}$ mol, per liter of the developing solution.

Further, the compounds disclosed in JP-A-56-24347, JP-B-56-46585, JP-B-62-2849, JP-A-4-362942 and JP-B-6-23830 can be used in a developing solution as an agent for preventing silver contamination.

In addition, the compounds disclosed in JP-A-62-212651 can be used as an agent for preventing the occurrence of uneven development, and the compounds disclosed in JP-A-61-267759 can be used as a dissolution aid.

Further, if necessary, a developing solution may contain a toning agent, a surfactant, a defoaming agent and a hardening agent.

The developing solution for use in the present invention contains, as a buffer, carbonate, the boric acid disclosed in JP-A-62-186259, the sugars disclosed in JP-A-60-93433 (e.g., saccharose), oximes (e.g., acetoxime), phenols (e.g., 5-sulfosalicylic acid), or tertiary phosphate (e.g., sodium salt, potassium salt), preferably carbonate and boric acid.

The pH of the developing solution is preferably from 9.0 to 12.0, particularly preferably from 9.5 to.11.0.

The development processing temperature and the development processing time are related reciprocally and determined in relationship with the total processing time, and the development temperature is generally from about 20° C. to about 50° C., preferably from 25° C. to 45° C., and the development time is from 5 seconds to 2 minutes, preferably from 7 seconds to 1 minute and 30 seconds.

When one square meter of a silver halide black-and-white photographic material is processed, the replenishment rate of the developing solution is 390 ml or less, preferably from 30 ml to 325 ml, particularly preferably from 120 ml to 180 ml. The compositions and/or concentration of the replenisher for the developing solution may be the same as or different from those of the initial developing solution (i.e., initial developer).

It is preferred to concentrate processing solutions for the sake of saving costs of transportation and packaging or saving spaces, and dilute to a predetermined concentration when it is used. For concentrating the developing solution, it is effective to make the salt component contained in the developing solution into potassium salt.

The fixing solution for use in the fixing step of the present invention is an aqueous solution containing sodium thiosulfate, ammonium thiosulfate and, if necessary, tartaric acid, citric acid, gluconic acid, boric acid, iminodiacetic acid, 5-sulfosalicylic acid, glucoheptanic acid, Tiron, ethylenediaminetetraacetic acid, diethylenetriaminepentaacetic acid, nitrilotriacetic acid, and the salts of these compounds. From the viewpoint of environmental protection, boric acid is preferably not contained.

Sodium thiosulfate and ammonium thiosulfate are used as a fixing agent of the fixing solution in the present invention, and ammonium thiosulfate is preferred from the point of fixing speed, but sodium thiosulfate is preferably used from the environmental protection in recent years. The amount used of these known fixing agents can be varied arbitrarily and is generally from about 0.1 to about 2 mol/liter, particularly preferably from 0.2 to 1.5 mol/liter.

The fixing solution can contain, if desired, a hardening agent (e.g., a water-soluble aluminum compound), a preservative (e.g., sulfite, bisulfite), a pH buffer (e.g., acetic acid), a pH adjustor (e.g., ammonia, sulfuric acid), a chelating agent, a surfactant, a wetting agent, and a fixing accelerator.

Specific examples of surfactants include an anionic surfactant, e.g., a sulfated product and a sulfonated product, a polyethylene surfactant, and the amphoteric surfactants disclosed in JP-A-57-6740, and known defoaming agents can also be used. Specific examples of wetting agents include alkanolamine and alkylene glycol. Specific examples of fixing accelerators include the thiourea derivatives disclosed in JP-B-45-35754, JP-B-58-122535 and JP-B-58-122536, an alcohol having a triple bond in the molecule, the thioether compounds disclosed in U.S. Pat. No. 4,126,459, the mesoionic compounds disclosed in JP-A-4-229860, the substituted sulfonic acids and the salts thereof disclosed in JP-A-6-308681, and the compounds disclosed in JP-A-2-44355 may also be used.

Further, as a pH buffer, e.g., organic acids such as acetic acid, malic acid, succinic acid, tartaric acid, citric acid, oxalic acid, maleic acid, glycolic acid, and adipic acid, and inorganic buffers such as boric acid, phosphate and sulfite can be used. Acetic acid, tartaric acid and sulfite are preferably used.

A pH buffer is used for preventing the increase of the pH value of the fixing solution by the carryover of the developing solution, and is used in an amount of from 0.01 to 1.0 mol/liter, more preferably from 0.02 to 0.6 mol/liter or so.

The pH of the fixing solution is preferably from 4.0 to 6.5, particularly preferably from 4.5 to 6.0.

Further, the compounds disclosed in JP-A-64-4739 can be used as a dissolution accelerator of a dye.

The fixing solution of the present invention contains a water-soluble aluminum salt and chromium salt as a hardening agent. Preferred compounds are a water-soluble aluminum salt, e.g., aluminum chloride, aluminum sulfate, aluminum lactate and potassium alum. They are preferably contained in an amount of from 0.01 to 0.2 mol/liter, more preferably from 0.03 to 0.15 mol/liter as an aluminum ion.

The temperature of the fixing solution is from about 20° C. to about 50° C., preferably from 25° C. to 45° C., and the fixing time is from 5 seconds to 1 minute, preferably from 7 seconds to 50 seconds.

The replenishment rate of the fixing solution is 500 ml/$m^2$ or less, preferably 390 ml/$m^2$ or less, more preferably from 320 to 80 ml/$m^2$, of the material processed. The compositions and/or concentration of the replenisher for the fixing solution may be the same as or different from those of the initial fixing solution (i.e., initial fixer).

A photographic material is subjected to washing or stabilizing processing after being development processed and fixing processed. Washing or stabilizing processing is, in general, carried out with a washing water of 20 liters or less per $m^2$ of the silver halide photographic material, and can be carried out with a replenishing rate of 3 liters or less per $m^2$ of the photographic material (including zero, i.e., washing in a reservoir). That is, not only water saving processing can be carried out but also piping for installation of an automatic processor is not required.

As a means of reducing the replenishment rate of the washing water, a multistage countercurrent system (e.g., two stages or three stages) has been known. If this multistage countercurrent system is applied to the present invention, the photographic material after fixation is in order contacted with and processed by plural processing solutions arranged in such a manner that the latter the order of the processing solution to be contacted is, the less is the contamination with a fixing solution, accordingly, further effective water washing can be conducted.

When washing is carried out with a reduced amount of water, it is preferred to use a washing tank equipped with a squeegee roller or a crossover roller disclosed in JP-A-63-18350 and JP-A-62-287252. The addition of various kinds of oxidizing agents and the provision of filters for filtration may be combined to reduce load in environmental pollution which becomes a problem when washing is carried out with a small amount of water.

Further, all or a part of the overflow generated from the washing tank or the stabilizing tank by the replenishment of the water applied with an antimold means by the method according to the present invention to the washing tank or the stabilizing tank in proportion to the progress of the processing can be utilized in the preceding processing step, i.e., a processing solution having a fixing ability as disclosed in JP-A-60-235133.

Moreover, a water-soluble surfactant or a defoaming agent may be included in a washing water to prevent generation of irregular due to foaming which is liable to occur when washing is conducted with a small amount of water and/or to prevent components of the processing agents adhered to a squeegee roller from transferring to the processed film.

In addition, the dye-adsorbents disclosed in JP-A-63-163456 may be included in a washing tank to inhibit contamination by dyes dissolved from photographic materials.

Also, when a photographic material is subjected to stabilizing processing after the above-described washing processing, a bath containing compounds disclosed in JP-A-2-201357, JP-A-2-132435, JP-A-1-102553 and JP-A-46-44446 may be used as a final bath.

This stabilizing bath may also contain, if desired, ammonium compounds, metal compounds such as Bi and Al, brightening agents, various kinds of chelating agents, film pH adjustors, hardening agents, sterilizers, antimold agents, alkanolamines, and surfactants. Tap water, deionized water, and water sterilized by a halogen, an ultraviolet sterilizing lamp or various oxidizing agents (e.g., ozone, hydrogen peroxide, chlorate) are preferably used as water in a washing step or a stabilizing step. Further, a washing water containing the compounds disclosed in JP-A-4-39652 and JP-A-5-241309 can also be used.

The temperature and the time of the washing or stabilizing processing are preferably from 0° to 50° C. and from 5 seconds to 2 minutes.

The processing solutions for use in the present invention are preferably preserved in the packaging materials of low oxygen permeation as disclosed in JP-A-61-73147.

The processing solutions for use in the present invention may be made into powders, granules, briquettes, tablets, pellets, paste or solids. Known methods can be used therefor, e.g., the methods disclosed in JP-A-61-259921, JP-A-4-85533 and JP-A-4-16841 are preferably used. The method disclosed in JP-A-61-259921 is particularly preferred.

In the case when the replenishment rate is reduced, it is preferred to prevent evaporation and air oxidation of the solution by minimizing the area of contact of the solution with the air in the processing tank. A roller transporting type automatic processor is disclosed in U.S. Pat. Nos. 3,025,779 and 3,545,971 and referred to as merely a roller transporting type processor in the specification of the present invention. A roller transporting type processor comprises four steps of development, fixation, washing and drying and, although the method of the present invention does not exclude other steps (e.g., stopping step), it is most preferred to follow this four step system. A washing step may be replaced with a stabilization step in the above four step system. The drying step is carried out at a temperature of from 40° to 100° C. and the time therefor can vary properly depending upon the surroundings. Examples of the drying methods include a warm air drying method, a heated roll drying method, and a far infrared ray or infrared ray drying method.

The present invention is described in detail below with reference to the specific examples, but the synthesis methods of the compounds according to the present invention and the embodiment of the present invention should not be construed as being limited thereto.

EXAMPLE 1

Synthesis of Compound I-1

1 g of triethylammonium 4-{2-[3-(2-hydroxyethyl) rhodanin-5-ylidene]-5-methoxy-3-benzothiazolyl}butanesulfonate, 50 ml of acetonitrile, 5 ml of pyridine, 400 mg of succinic anhydride, and 400 mg of triethylamine were placed in a flask having a capacity of 100 ml and heated under reflux for one hour. After the solvent was distilled off under reduced pressure, the reaction mixture was dissolved in 10 ml of ethanol, and 30 ml of isopropyl alcohol was added thereto. The precipitated crystals were recovered by filtration, washed with ethanol, recrystallized from methanol and subjected to purification to obtain 840 mg of Compound I-1.

$\lambda max$ (MeOH)=433 nm, $\epsilon=6.27\times10^4$

EXAMPLE 2

Synthesis of Compound I-2

3.7 g of triethylammonium 3-{2-[3-(2-hydroxyethyl) rhodanin-5-ylidene]-3-benzothiazolyl}propanesulfonate, 140 ml of acetonitrile, 10 ml of triethylamine, and 3 g of succinic anhydride were placed in a flask having a capacity of 100 ml and heated under reflux for 3 hours. After the solvent was distilled off under reduced pressure, the obtained reaction product was recrystallized from methanol and subjected to purification to obtain 3.7 g of Compound I-2.

λmax (MeOH)=429 nm, $\epsilon=6.19\times10^4$

Synthesis of Compound I-3

1.4 g of triethylammonium 3-{2-[3-(2-hydroxyethyl) rhodanin-5-ylidene]-5-methoxy-3-benzothiazolyl}-1-methylpropanesulfonate, 20 ml of pyridine, 343 mg of succinic anhydride, and 2 ml of triethylamine were placed in a flask having a capacity of 100 ml and stirred at 80° C. for 3 hours. After the solvent was distilled off under reduced pressure, the reaction mixture was dissolved in 100 ml of ethanol, and 1 g of potassium acetate dissolved in 30 ml of ethanol was added thereto. The precipitated crystals were recovered by filtration, washed with ethanol, recrystallized from a mixed solvent of methanol and acetonitrile and subjected to purification to obtain 1.3 g of Compound I-3.

λmax (MeOH)=435 nm, $\epsilon=5.39\times10^4$

Synthesis of Compound I-7

1 g of triethylammonium 4-{2-[3-(2-hydroxyethyl) rhodanin-5-ylidene]-5-methoxy-3-benzothiazolyl}butanesulfonate, 20 ml of pyridine, 1 g of diglycolic anhydride, and 2 ml of triethylamine were placed in a flask having a capacity of 100 ml and heated at 50° C. for 8 hours. After the solvent was distilled off under reduced pressure, the reaction mixture was dissolved in 100 ml of ethanol, and 1 g of potassium acetate dissolved in 50 ml of ethanol was added thereto. The precipitated crystals were recovered by filtration, washed with ethanol, recrystallized from a mixed solvent of methanol and acetonitrile and subjected to purification to obtain 1.05 g of Compound I-7.

λmax (MeOH)=434 nm, $\epsilon=5.88\times10^4$

Synthesis of Compound I-9

1.5 g of disodium {5-[5-methoxy-3-(4-sulfobutyl) benzothiazol-2-ylidene]rhodanin-3-yl}acetate, 910 mg of carbonyldiimidazole, and 50 ml of dimethylformamide were placed in a flask having a capacity of 300 ml, and stirred at room temperature for 3 hours to precipitate yellow crystals. 530 mg of sodium 3-hydroxybutyrate dissolved in 100 ml of dimethylformamide was dropwise added thereto, then stirred at 80° C. for 4 hours. After the solvent was distilled off under reduced pressure, the reaction mixture was dissolved in 50 ml of ethanol, and 1 g of sodium acetate dissolved in 100 ml of ethanol was added thereto. The precipitated crystals were recovered by filtration, washed with ethanol, recrystallized from a mixed solvent of methanol and acetonitrile and subjected to purification to obtain 1.47 g of Compound I-9.

λmax (MeOH)=429 nm, $\epsilon=5.93\times10^4$

Synthesis of Compound I-10

1.8 g of di(triethylammonium) {5-[5-methoxy-3-(3-sulfopropyl)benzothiazol-2-ylidene]rhodanin-3-yl}acetate, 910 mg of carbonyldiimidazole, and 40 ml of dimethylformamide were placed in a flask having a capacity of 300 ml, and stirred at room temperature for 2 hours and 30 minutes to precipitate yellow crystals. 530 mg of sodium 3-hydroxybutyrate dissolved in 100 ml of dimethylformamide was dropwise added thereto, then stirred at 80° C. for 4 hours. After the solvent was distilled off under reduced pressure, the reaction mixture was dissolved in 50 ml of ethanol, and 1 g of potassium acetate dissolved in 50 ml of ethanol was added thereto. The precipitated crystals were recovered by filtration, washed with ethanol, recrystallized from a mixed solvent of methanol and acetonitrile and subjected to purification to obtain 1.65 g of Compound I-10.

λmax (MeOH)=431 nm, $\epsilon=5.88\times10^4$

Synthesis of Compound I-11

1.2 g of triethylammonium {5-[5-methoxy-3-(4-sulfobutyl)benzothiazol-2-ylidene]rhodanin-3-yl}acetate, 1.5 g of N,N'-disuccinimidyl carbonate, and 40 ml of dimethylformamide were placed in a flask having a capacity of 100 ml, and stirred at room temperature for 6 hours. 1 g of lactic acid and 210 mg of triethylamine were added thereto and stirred at 50° C. for 2 hours. After the solvent was distilled off under reduced pressure, the reaction mixture was dissolved in 100 ml of ethanol, and 1 g of potassium acetate dissolved in 50 ml of ethanol was added thereto. The precipitated crystals were recovered by filtration, washed with ethanol, recrystallized from a mixed solvent of methanol and acetonitrile and subjected to purification to obtain 1.03 g of Compound I-11.

λmax (MeOH)=433 nm, $\epsilon=6.13\times10^4$

Synthesis of Compound I-12

1 g of triethylammonium 4-{2-[3-(2-hydroxyethyl) rhodanin-5-ylidene]-5-methoxy-3-benzothiazolyl}butanesulfonate, 20 ml of dimethylformamide, 1 g of maleic anhydride, and 1 ml of triethylamine were placed in a flask having a capacity of 100 ml and stirred at room temperature for 7 hours. After the solvent was distilled off under reduced pressure, the reaction mixture was dissolved in 100 ml of ethanol, and 1 g of potassium acetate dissolved in 50 ml of ethanol was added thereto. The precipitated crystals were recovered by filtration, washed with ethanol, recrystallized from a mixed solvent of methanol and acetonitrile and subjected to purification to obtain 920 mg of Compound I-12.

λmax (MeOH)=434 nm, $\epsilon=6.03\times10^4$

Synthesis of Compound I-14

1 g of triethylammonium 4-[2-{3-[2-(2-hydroxyethoxy) ethyl]rhodanin-5-ylidene}-5-methoxy-3-benzothiazolyl] butanesulfonate, 20 ml of pyridine, 400 mg of succinic anhydride, and 2 ml of triethylamine were placed in a flask having a capacity of 100 ml and stirred at room temperature for 2 hours and 30 minutes. After the solvent was distilled off under reduced pressure, the reaction mixture was dissolved in 50 ml of methanol, and 1 g of potassium acetate dissolved in 50 ml of ethanol was added thereto. The precipitated crystals were recovered by filtration, washed with ethanol, recrystallized from a mixed solvent of methanol and acetonitrile and subjected to purification to obtain 540 mg of Compound I-14.

λmax (MeOH)=434 nm, $\epsilon=5.74\times10^4$

Synthesis of Compound I-15

960 mg of triethylammonium 3-[2-{3-[2-(2-hydroxyethoxy)ethyl]rhodanin-5-ylidene}-5-methoxy-3-benzothiazolyl]- 1-methylpropanesulfonate, 20 ml of pyridine, 400 mg of succinic anhydride, and 2 ml of triethylamine were placed in a flask having a capacity of 100 ml and stirred at 80° C. for 2 hours and 30 minutes. After the solvent was distilled off under reduced pressure, the reaction mixture was dissolved in 50 ml of methanol, and 1 g of potassium acetate dissolved in 50 ml of ethanol was added thereto. The precipitated crystals were recovered by filtration, washed with ethanol, recrystallized from a mixed solvent of methanol and acetonitrile and subjected to purification to obtain 890 mg of Compound I-15.

λmax (MeOH)=434 nm, $\epsilon=5.56\times10^4$

Synthesis of Compound I-18

13.2 g of glycylglycine, 200 ml of methanol, 20 g of triethylamine, and 15 g of carbon disulfide were placed in a flask having a capacity of 500 ml, and stirred at 30° C. for 1 hour. 12.3 g of ethyl chloroacetate dissolved in 50 ml of methanol was dropwise added thereto, then stirred at room temperature for 30 minutes. The obtained solution was yellowish orange. After the solvent was distilled off under reduced pressure, 50 ml of ethanol was added, and 15 g of potassium acetate dissolved in 300 ml of ethanol was further added thereto. The precipitated crystals were recovered by filtration, washed with ethanol to thereby obtain 15.4 g of rhodanine-3-ylmethylcarbamoylacetic acid.

2.35 g of 5-methoxy-3-[(4-sulfobutyl)thio] benzothiazolio-3-(4-butanesulfonato), 1.43 g of rhodanin-3-yl-methylcarbamoylacetic acid, 30 ml of methanol, 2 g of triethylamine, and 30 ml of acetonitrile were placed in a flask having a capacity of 200 ml and stirred at room temperature for one hour. 2.2 g of potassium acetate dissolved in 100 ml of methanol was added thereto and stirred at room temperature for another one hour. The precipitated crystals were recovered by filtration, washed with methanol under heating and subjected to purification to obtain 2.87 g of Compound I-18.

λmax (MeOH)=432 nm, $\epsilon=6.28\times10^4$

Compound I-8 was synthesized in the same manner as the synthesis of Compound I-2.

EXAMPLE 3

Preparation of Silver Halide Photographic Material

Preparation of Emulsion

| Emulsion A | |
|---|---|
| Solution 1 | |
| Water | 750 ml |
| Gelatin | 20 g |
| Sodium Chloride | 2 g |
| 1,3-Dimethylimidazolidine-2-thione | 20 mg |
| Sodium Thiosulfonate | 10 mg |
| Solution 2 | |
| Water | 300 ml |
| Silver Nitrate | 150 g |
| Solution 3 | |
| Water | 300 ml |
| Sodium Chloride | 38 g |
| Potassium Bromide | 32 g |
| $K_3IrCl_6$ | 0.25 mg |
| $K_2Rh(H_2O)Cl_5$ | 0.07 mg |

Solution 2 and Solution 3 in the amounts corresponding to 90% of each were simultaneously added to Solution 1 maintained at 38° C. and pH 4.5 over a period of 20 minutes with stirring, and nucleus grains having a diameter of 0.19 μm were formed. Subsequently, Solution 4 and Solution 5 shown below were added over a period of 8 minutes. Further, the remaining amounts of 10% of Solution 2 and Solution 3 were added over a period of 2 minutes to obtain silver chlorobromide grains having an average grain size of 0.22 μm and a silver chloride content of 70 mol %.

| Solution 4 | |
|---|---|
| Water | 100 ml |
| Silver Nitrate | 50 g |
| Solution 5 | |
| Water | 100 ml |
| Sodium Chloride | 14 g |
| Potassium Bromide | 11 g |

Subsequently, a solution of KI was added to each emulsion in an amount of $1\times10^{-3}$ mol and conversion was conducted. The resulting emulsion was washed according to the ordinary flocculation method and 40 g of gelatin per mol of the silver was added. Further, 7 mg of sodium benzenethiosulfonate and 2 mg of benzenesulfinic acid, each per mol of the silver, were added to adjust the pH and pAg to 5.7 and 7.5, respectively, then 1 mg of sodium thiosulfate and Compound (CS-A), each per mol of the silver, and 5 mg of chloroauric acid were added and optimal chemical sensitization was carried out at 55° C. Further, 150 mg of 4-hydroxy-6-methyl-1,3,3a,7-tetraazaindene as a stabilizer and 100 mg of proxel as a preservative were added. The obtained grains were cubic silver iodochlorobromide grains having an average grain size of 0.22 μm and a silver chloride content of 70 mol % (variation coefficient: 10%).

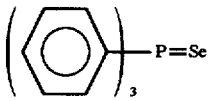

CS-A

Preparation of Coated Sample

On a polyethylene terephthalate film support having a moisture preventing undercoat layer containing vinylidene chloride, a UL layer, an EM layer, a PC layer and an OC layer were coated in this order from the support side to prepare a sample.

The preparation method and the coating amount of each layer are shown below.

UL Layer 0.5 g/m² of gelatin, 150 mg/m² of polyethyl acrylate dispersion and 5 mg/m² of the following Dye (a) were coated on a support as a UL layer.

EM Layer

To the above emulsion were added the sensitizing dye shown in Table 1 in an amount of $5\times10^{-4}$ mol per mol of the silver, 5 mg per mol of the silver of KBr, a mercapto compound represented by the following formula (a) in an amount of $3\times10^{-4}$ mol, a mercapto compound represented by the following formula (b) in an amount of $4\times10^{-4}$ mol, a triazine compound represented by the following formula (c) in an amount of $4\times10^{-4}$ mol, 5-chloro-8-hydroxyquinoline in an amount of $2\times10^{-3}$ mol, a hydrazine nucleating agent represented by the following formula (H) in an amount of $1\times10^{-4}$ mol, a nucleating accelerator represented by the following formula A-1 in an amount of $4\times10^{-4}$ mol and a nucleating accelerator represented by the following formula A-2 in an amount of $4\times10^{-4}$ mol, each per mol of the silver. Further, thereto were added 100 mg/m² of hydroquinone, 20 mg/m² of sodium salt of N-oleyl-N-methyltaurine, 20 mg/m² of sodium dodecylbenzenesulfonate, 15 mg/m² of a compound represented by the following formula (d), 200 mg/m$^2$ of colloidal silica having an average particle size of 0.02 μm, 200 mg/m$^2$ of a water-soluble polymer latex represented by the following formula (e), 200 mg/m$^2$ of polyethyl acrylate dispersion, and 200 mg/m$^2$ of a latex copolymer of methyl acrylate/sodium 2-acrylamido-2-methylpropanesulfonate/2-acetoacetoxyethyl methacrylate (88/5/7 by weight). Still further, 200 mg/m$^2$ of 1,3-divinylsulfonyl-2-propanol as a hardening agent was added thereto. The pH value of the emulsion was adjusted to 5.5 with acetic acid. The thus-obtained coating solution was coated on a support to provide a coated silver weight of 3.5 g/m$^2$ and a coated gelatin weight of 1.5 g/m$^2$.

PC Layer 0.5 g/m$^2$ of gelatin, 250 mg/m$^2$ of polyethyl acrylate dispersion, 5 mg/m$^2$ of sodium ethylsulfonate, and 10 mg/m$^2$ of 1,5-dihydroxy-2-benzaldoxime were coated on a support.

OC Layer 0.3 g/m$^2$ of gelatin, 40 mg/m$^2$ of an amorphous $SiO_2$ matting agent having an average grain size of about 3.5 μm, 100 mg/m$^2$ of a colloidal silica having an average grain size of 0.02 μm, 100 mg/m$^2$ of a methanol silica, 100 mg/m$^2$ of polyacrylamide, 20 mg/m$^2$ of a silicone oil, 30 mg/m$^2$ of a compound represented by the following formula (f), 5 mg/m$^2$ of a fluorine surfactant represented by the following formula (g) as a coating aid, and 50 mg/m$^2$ of sodium dodecylbenzenesulfonate were coated on a support.

Dye (a)

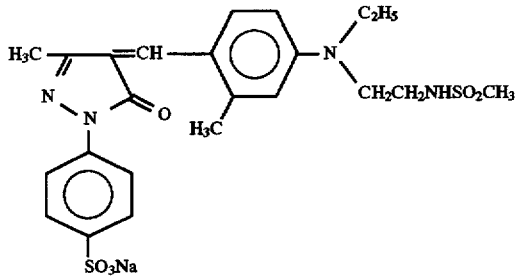

(a)

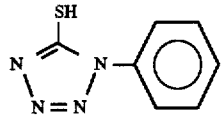

(b)

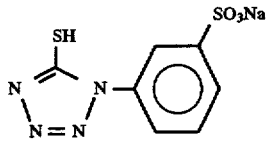

(c)

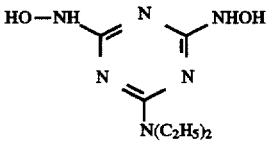

(d)

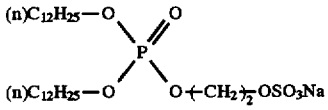

(e)

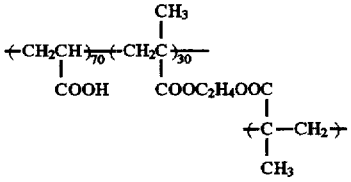

(f)

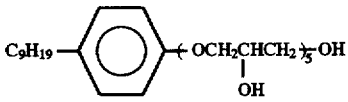

(g)

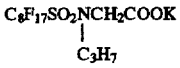

A-1

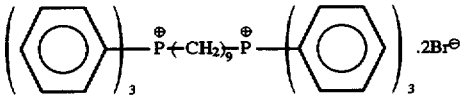

A-2

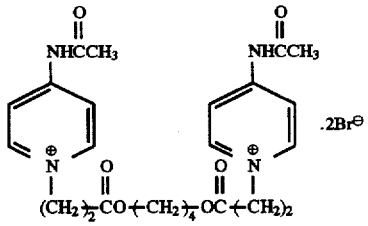

(H)

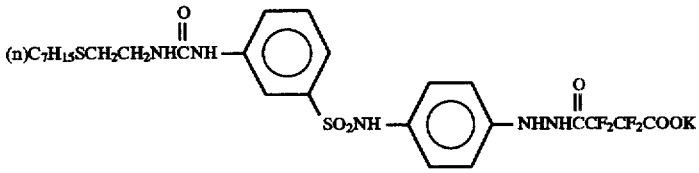

These coated samples have a backing layer and a backing protective layer of the following compositions.

Formulation of Backing Layer

| | |
|---|---|
| Gelatin | 3 g/m$^2$ |
| Polyethyl Acrylate (latex) | 2 g/m$^2$ |
| Sodium p-Dodecylbenzenesulfonate (surfactant) | 40 mg/m$^2$ |
| Compound (a) | 110 mg/m$^2$ |

-continued

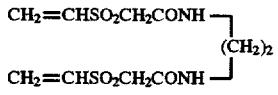

$SnO_2$/Sb (weight ratio: 90/10, (average grain size: 0.20 μm) 200 mg/m²

Dye (mixture of Dye (b), Dye (c) and Dye (d)):

Dye (b) 100 mg/m²

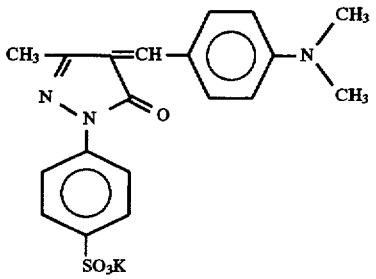

Dye (c) 30 mg/m²

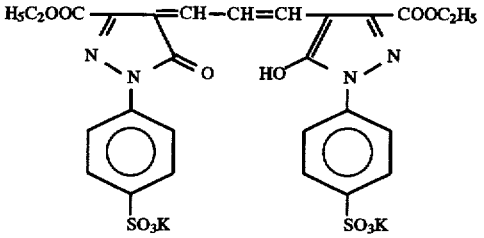

Dye (d) 60 mg/m²

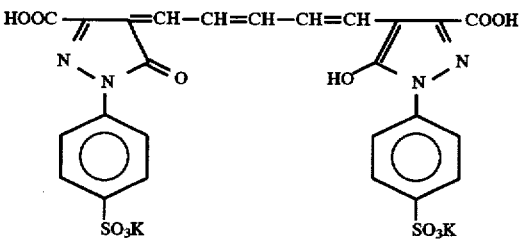

Backing Protective Layer

| | |
|---|---|
| Gelatin | 0.8 mg/m² |
| Fine Particles of Polymethyl Methacrylate (average particle size: 4.5 μm) | 30 mg/m² |
| Sodium Diheryl-α-sulfosuccinate | 15 mg/m² |
| Sodium p-Dodecylbenzenesulfonate | 15 mg/m² |
| Sodium Acetate | 40 mg/m² |

Exposure and Development Processing (1) Evaluation of Photographic Capabilities

Each of the above samples was exposed with xenon flash light of emission time of $10^{-5}$ sec. through an interference filter which had a peak at 488 nm and through a step wedge, and subjected to developing (35° C., 30 sec.), fixing, washing and drying using automatic processor FG-680AG, produced by Fuji Photo Film Co., Ltd. A developing solution and a fixing solution had the following compositions.

Formulation of Developing Solution (Developing Solution A)

| | |
|---|---|
| Potassium Hydroxide | 35.0 g |
| Diethylenetriaminepentaacetic Acid | 2.0 g |
| Sodium Metabisulfate | 40.0 g |
| Potassium Carbonate | 40.0 g |
| Potassium Bromide | 3.0 g |
| 5-Methylbenzenetriazole | 0.08 g |
| 2,3,5,6,7,8-Hexahydro-2-thioxo-4-(1H)-quinazolinone | 0.04 g |
| Sodium 2-Mercaptobenzimidazole-5-sulfonate | 0.15 g |
| Hydroquinone | 25.0 g |
| 4-Hydroxymethyl-4-methyl-1-phenyl-3-pyrazolidone | 0.45 g |
| Sodium Erythorbate | 3.0 g |
| Diethylene Glycol | 20.0 g |
| Water to make | 1 liter |
| pH (pH was adjusted with potassium hydroxide) | 10.45 |

Formulation of Fixing Solution

| | |
|---|---|
| Ammonium Thiosulfate | 359.1 g |
| Disodium Ethylenediaminetetraacetate Dihydrate | 0.1 g |
| Sodium Thiosulfate Pentahydrate | 32.8 g |
| Sodium Sulfite | 64.8 g |
| NaOH | 37.2 g |
| Glacial Acetic Acid | 87.3 g |
| Tartaric Acid | 8.76 g |
| Sodium Gluconate | 6.6 g |
| Aluminum Sulfate | 25.3 g |
| pH (adjusted with sulfuric acid or sodium hydroxide) | 4.85 |
| Water to make | 3 liters |

The reciprocal of the exposure required to give a density of 1.5 was taken as the sensitivity and this is shown as a relative sensitivity. The larger the value, the higher is the sensitivity. The gradient of the straight line joining the points of fog +density 0.3 and fog +density 3.0 of the characteristic curve was taken as the index (γ value) showing the contrast of images. That is, γ=(3.0–0.3)/[log(exposure amount giving a density of 3.0)–log(exposure amount giving a density of 0.3)]. The larger the gamma value, the higher is the contrast.

(2) Evaluation of Black Peppers

Black peppers of the samples were evaluated microscopically in five grades. The five grades of evaluation represent from "5" no generation of black peppers and being best to "1" extreme generation of black peppers and being worst. "3" is at a limiting level for practical use.

(3) Evaluation of Safelight Safety

Each sample was exposed to 20 Lux of light using SLF-1B (safelight for yellow light) produced by Fuji Photo Film Co., Ltd. and the time until fog increased was measured. The larger the value, the higher is the safelight safety.

(4) Evaluation of Running Stability

Samples were processed and evaluated in the same manner as the processing in (1) Evaluation of Photographic Capabilities except that exhausted developing solutions 1 and 2 shown below were used in place of the above developing solution A.

Exhausted Developing Solution 1

Running processing of the sample of blackening ratio of 80% was conducted in such a manner that 50 m² of the sample was processed per a day with replenishing 160 ml of a replenisher per m² of the sample using automatic processor FG-680A produced by Fuji Photo Film Co., Ltd. and developing solution A and 300 m² in total of the sample was running processed, and exhausted developing solution 1 was prepared.

Exhausted Developing Solution 2

Running processing of the sample of blackening ratio of 20% was conducted in such a manner that 5 m² of the sample was processed per a day with replenishing 160 ml of a replenisher per $m^2$ of the sample using automatic processor FG-680A and developing solution A and 300 $m^2$ in total of the sample was running processed, and exhausted developing solution 2 was prepared.

(5) Evaluation of Storage Stability

After the above samples were allowed to stand for 3 days at 60° C., 65% RH, evaluation of photographic capabilities was carried out under the conditions (1) described above. The change of the sensitivity was shown as a variation taken the sensitivity of the sample allowed to stand for 3 days at room temperature as 100.

(6) Evaluation of Residual Color

Unexposed samples were development processed under the same conditions as in (1) evaluation of photographic capabilities with developing solution A and evaluated in five grades. The five grades of evaluation represent from almost no residual color to "5" the largest residual color. "1" and "2" are practicable and "3" is at a limiting level for practical use and "4" and "5" are impracticable.

Results

Samples of the present invention are excellent in high contrast and safelight safety, and it can be seen that even when processed using exhausted developing solutions, fluctuations in sensitivity and gradation are small and that fluctuation in capabilities after forced aging is small. On the contrary, when the comparative sample containing comparative sensitizing dye D-A was processed with exhausted developing solutions, fluctuations in sensitivity and gradation were large and residual color was remarkably generated. With respect to comparative sample which contains comparative sensitizing dye D-B, sensitivity was low and fluctuations in sensitivity and gradation by processing with fatigued developing solutions were large. The sample which contains sensitizing dye D-C was inferior in safelight safety and desensitization after aging was large.

From the above results, it can be understood that the photographic materials of the present invention show high contrast against exposure of 488 nm wavelength, are excellent in yellow safelight safety, high in running stability and storage stability and generate almost no residual colors, therefore, the materials are excellent materials for an Ar scanner (i.e., a scanner using an argon laser as a light source).

TABLE 1

| | | Developing Solution A | | | | | Exhausted Developing Solution 1 | | | Exhausted Developing Solution 2 | | | After Forced Aging | | |
|---|---|---|---|---|---|---|---|---|---|---|---|---|---|---|---|
| Sample No. | Sensitizing Dye | Sensitivity | γ | Black Pepper | Safelight | Residual Color | Sensitivity | γ | Black Pepper | Sensitivity | γ | Black Pepper | Sensitivity | γ | Remarks |
| 1 | I-1 | 100 | 23 | 5 | >20' | 1 | 98 | 22 | 5 | 103 | 24 | 5 | +2 | 22 | Invention |
| 2 | I-3 | 108 | 22 | 5 | >20' | 1 | 102 | 22 | 5 | 110 | 23 | 5 | ±0 | 22 | Invention |
| 3 | I-7 | 113 | 22 | 5 | >20' | 1 | 110 | 21 | 5 | 115 | 23 | 5 | +3 | 22 | Invention |
| 4 | I-8 | 102 | 23 | 5 | 20' | 2 | 99 | 23 | 5 | 105 | 22 | 5 | −2 | 22 | Invention |
| 5 | I-15 | 110 | 22 | 5 | >20' | 1 | 108 | 22 | 5 | 113 | 21 | 5 | −3 | 21 | Invention |
| 6 | I-18 | 104 | 22 | 5 | >20' | 1 | 100 | 21 | 5 | 110 | 22 | 5 | ±0 | 22 | Invention |
| 7 | I-19 | 110 | 22 | 5 | >20' | 2 | 108 | 22 | 5 | 108 | 23 | 5 | +3 | 22 | Invention |
| 8 | D-A | 100 | 22 | 5 | >20' | 4 | 92 | 20 | 5 | 104 | 16 | 5 | ±0 | 22 | Comparison |
| 9 | D-B | 85 | 20 | 3 | >20' | 1 | 78 | 18 | 3 | 95 | 12 | 3 | −3 | 21 | Comparison |
| 10 | D-C | 95 | 18 | 4 | 5' | 2 | 90 | 16 | 5 | 93 | 9 | 4 | −28 | 17 | Comparison |

Comparative Compound

D-A

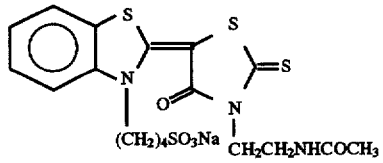

D-B

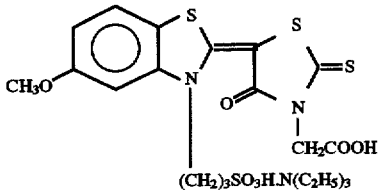

D-C

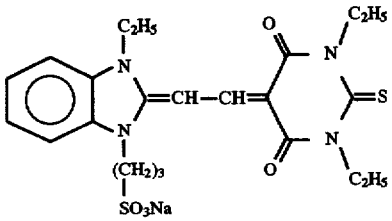

EXAMPLE 4

Development processing was carried out using the photographic material prepared in Example 3 under the development processing conditions in Example 3 using the following developing solutions B and C in place of developing solution A used in Example 3.

Developing Solution B

| | |
|---|---|
| Potassium Hydroxide | 35.0 g |
| Diethylenetriaminepentaacetic Acid | 2.0 g |
| Sodium Metabisulfate | 54.0 g |
| Potassium Carbonate | 100.0 g |
| Potassium Bromide | 3.0 g |
| 5-Methylbenzenetriazole | 0.08 g |
| 2,3,5,6,7,8-Hexahydro-2-thioxo-4-(1H)-quinazolinone | 0.03 g |
| Sodium 2-Mercaptobenzimidazole-5-sulfonate | 0.15 g |
| Hydroquinone | 30.0 g |
| 4-Hydroxymethyl-4-methyl-1-phenyl-3-pyrazolidone | 0.45 g |
| Sodium Erythorbate | 3.0 g |

-continued

| | |
|---|---|
| Water to make | 1 liter |
| pH (pH was adjusted with potassium hydroxide) | 10.5 |

Developing Solution C

| | |
|---|---|
| Potassium Hydroxide | 10.0 g |
| Diethylenetriaminepentaacetic Acid | 1.5 g |
| Potassium Carbonate | 15.0 g |
| Potassium Bromide | 3.0 g |
| 5-Methylbenzenetriazole | 0.10 g |
| 1-Phenyl-5-mercaptotetrazole | 0.02 g |
| Potassium Sulfite | 10.0 g |
| Sodium 2-Mercaptobenzimidazole-5-sulfonate | 0.15 g |
| 4-Hydroxymethyl-4-methyl-1-phenyl-3-pyrazolidone | 0.40 g |
| Sodium Erythorbate | 30.0 g |
| Water to make | 1 liter |
| pH (pH was adjusted with potassium hydroxide) | 10.7 |

Further, developing solution B was prepared from a solid type when preserved.

A component of a developing solution was put into a bag of an aluminum foil coated on a plastic material in lamination as a solid state. The order of lamination was from the above:

First Layer: Hydroquinone

Second Layer: Other component

Third Layer: Sodium Bisulfite

Fourth Layer: Potassium Carbonate

Fifth Layer: Potassium Hydroxide Pellet

Exhaust was conducted in the ordinary method. The system was made vacuum and sealed.

Results

The same results as in Example 3 were obtained when using developing solutions B and C.

EXAMPLE 5

Samples prepared in Example 3 were coated on the following support and evaluated under the same conditions as in Examples 3 and 4.

Producing Method of Support (1) Preparation of contact product of trimethylaluminum with water 17.8 g (71 mmol) of cupric sulfate pentahydrate ($CuSO_4.5H_2O$), 200 ml of toluene and 24 ml (250 mmol) of trimethylaluminum were put in an argon-substituted glass container having a capacity of 500 ml and reacted at 40° C. for 8 hours. Then, a solution was obtained by removing the solid component from the reaction product. Further, toluene was distilled off from the solution under reduced pressure at room temperature to obtain a contact product. The molecular weight of the contact product measured by a cryoscopic method was 610.

(2) Production of styrene polymer

A polymerization reaction was conducted at 90° C. for 5 hours in a reaction vessel having a capacity of 2 liters using 950 ml of purified styrene, 50 ml of p-methylstyrene, 5 mmol in terms of an aluminum atom of the contact product obtained in (1) above, 5 mmol of triisobutylaluminum, and 0.025 mmol of pentamethylcyclopentadienyl titanium trimethoxide. After the reaction was finished, the catalytic component of the obtained product was decomposed by sodium hydroxide dissolved in a solution of methanol, the product was washed with methanol repeatedly, and dried to obtain 308 g of a polymer.

The obtained polymer was confirmed by $^{13}C$-NMR to have a cosyndiotactic structure and contain 9.5 mol % of p-methylstyrene unit. The weight average molecular weight was 438,000 and weight average molecular weight/number average molecular weight was 2.51.

(3) Production of support

The styrene polymer obtained in (2) was dried under reduced pressure at 150° C., then pelletized by a monoaxial extruder having a vent and these pellets were crystallized by stirring in air of 130° C. The content of the styrene monomer in crystallized pellets was 1,100 ppm.

Then the pellets were extruded with a device having a T-type die at the tip of an extruder having a filter inside therein. The melting time at this time was 300° C.

This sheet in a molten state was stretched 3.5 times in a machine direction at 110° C. and 4 times in a transverse direction at 120° C., and heat treated at 240° C. in fixed stretching condition for 10 seconds and in 5% restricted contraction for 20 seconds. The thickness of the obtained film was 100 μm and haze was 1.0%.

Both surfaces of the syndiotactic polystyrene (SPS) support obtained was glow discharged as follows.

Four cylindrical electrodes were fixed like an insulating plate with the distance of 10 cm. Each electrode has a hollow part as a flow route of cooling medium, and has the cross sectional diameter of 2 cm and the length of 150 cm. This electrode plate was fixed in a vacuum tank, biaxially stretched film was traveled so as to face the surface of the electrode 15 cm apart from the surface of the electrode, and the traveling speed was controlled so that the surface treatment were carried out for 2 seconds.

A heating roll was positioned such that the film contacted by ¾ round with the heating roll of 50 cm in diameter and having a temperature controller immediately before the film passes the electrode. Further, the temperature of the film was controlled to 115° C. by contacting a thermocouple thermometer with the film face between the heating roll and electrode zone.

The pressure within the vacuum tank was 0.2 Torr, and partial pressure of $H_2O$ in the atmosphere was 75%. Discharge frequency was 30 kHz, output was 2,500 W, treating strength was 0.5 kV.A.min/m$^2$. The film was wound around after contacting with a cooling roll of diameter of 50 cm having a temperature controller so that the surface temperature of the discharge-treated support was 30° C.

The both surfaces of the support were coated the following undercoat layer.

Undercoat Layer

| | |
|---|---|
| Deionized Alkali-Processed Gelatin (isoelectric point: 5.0) | 10.0 wt part |
| Water | 24.0 wt part |
| Methanol | 961.0 wt part |
| Salicylic Acid | 3.0 wt part |
| Polyamide-Epichlorohydrin Resin (Synthesis Example 1, JP-A-1-3619) | 0.5 wt part |
| Nonionic Surfactant (Compound I-13, JP-B-3-27099) | 1.0 wt part |

This coating solution was coated in an amount of ml/m$^2$ with a wire bar coater and wound after drying at 115° C. for 2 minutes.

Results

With the sample using the above support, the same results as in Examples 3 and 4 were obtained.

While the invention has been described in detail and with reference to specific examples thereof, it will be apparent to one skilled in the art that various changes and modifications can be made therein without departing from the spirit and scope thereof.

What is claimed is:

1. A silver halide photographic material comprising a support having provided thereon a light-sensitive silver halide emulsion layer, said silver halide photographic material containing at least one spectral sensitizing dye represented by the following formula (I):

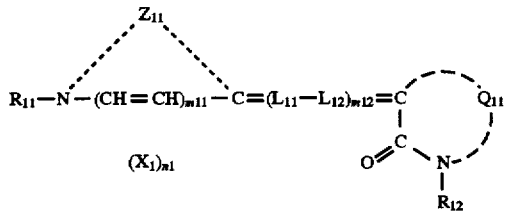

(I)

wherein $Z_{11}$ represents a nonmetal atomic group necessary for completing a 5- or 6-membered nitrogen-containing heterocyclic ring; $Q_{11}$ represents a nonmetal atomic group necessary for completing a 5-membered nitrogen-containing heterocyclic ring; $R_{11}$ represents a substituted or unsubstituted alkyl group; $R_{12}$ represents a carboxyalkoxycarbonylmethyl group or a carboxyalkylcarbonyloxyalkyl group,; $L_{11}$ and $L_{12}$ each represents a methine group; $m_{11}$ represents 0 or 1; $m_{12}$ represents 0, 1 or 2: $X_1$ represents a counter ion necessary for neutralizing a charge; and $n_1$ represents a number of 0 or more necessary for neutralizing a charge in the molecule.

2. The silver halide photographic material as claimed in claim 1, wherein $Z_{11}$ represents a nonmetal atomic group necessary for completing oxazole, benzothiazole, naphtho[1,2-d]thiazole, naphtho[2,1-d]thiazole, naphtho-[2,3-d]thiazole, thiazole or thiazoline.

3. The silver halide photographic material as claimed in claim 2, wherein $Z_{11}$ represents a nonmetal atomic group necessary for completing benzothiazole.

4. The silver halide photographic material as claimed in claim 1, wherein $Q_{11}$ represents a nonmetal atomic group necessary for completing 3-alkylrhodanine, 3-alkyloxazolidine-2-thione-4-one or 3-alkyl-2-thiohydantoin.

5. The silver halide photographic material as claimed in claim 4, wherein $Q_{11}$ represents a nonmetal atomic group necessary for completing 3-alkylrhodanine.

6. The silver halide photographic material as claimed in claim 1, wherein $R_{11}$ represents a methyl group, an ethyl group, a propyl group, a butyl group, a hydroxyalkyl group, a sulfoalkyl group, a 2-sulfatoethyl group, a 3-sulfatopropyl group, a carboxyalkyl group, a trifluoromethyl group, a 2,2,2-trifluoroethyl group, a 2-(3-sulfopropoxy)-ethyl group, a 2-(2-hydroxyethoxy)ethyl group, an ethoxycarbonylethyl group, a methylsulfonylethyl group, a sulfamoylalkyl group, a phenethyl group, a p-carboxyphenethyl group, an o-sulfophenethyl group, a p-hydroxyphenethyl group, an allyl group or a phenoxyethyl group.

7. The silver halide photographic material as claimed in claim 6, wherein $R_{11}$ represents an ethyl group, a 2-sulfoethyl group, a 3-sulfopropyl group, a 3-sulfobutyl group or a 4-sulfobutyl group.

8. The silver halide photographic material as claimed in claim 1, wherein $R_{12}$ represents a carboxyethoxycarbonylmethyl group, a 2-[(2-carboxyethoxy)carbonyl]ethyl group, a (2-carboxy-1-methylethoxy)carbonylmethyl group or a (3-carboxypropyloxy)carbonylmethyl group.

9. The silver halide photographic material as claimed in claim 1, wherein $X_1$ represents a sodium ion, a potassium ion, a triethylammonium ion, a pyridinium ion, an iodide ion, a bromide ion, a chloride ion, a methanesulfonate ion or a p-toluenesulfonate ion.

10. The silver halide photographic material as claimed in claim 9, wherein $X_1$ represents a sodium ion, a potassium ion or a triethylammonium ion.

11. The silver halide photographic material as claimed in claim 1, wherein said at least one spectral sensitizing dye represented by formula (I) is added in an amount of from $1\times10^{-5}$ to $1\times10^{-2}$ mol per mol of the silver.

12. The silver halide photographic material as claimed in claim 11, wherein said at least one spectral sensitizing dye represented by formula (I) is added in an amount of from $1\times10^{-5}$ to $5\times10^{-3}$ mol per mol of the silver.

13. The silver halide photographic material as claimed in claim 1, wherein said silver halide photographic material further contains at least one or more hydrazine derivatives represented by the following formula (II) in silver halide emulsion layers or other hydrophilic colloid layers thereof:

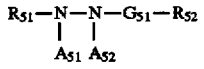

(II)

wherein $R_{51}$ represents an aliphatic or aromatic group; $R_{52}$ represents a hydrogen atom, an alkyl group, an aryl group, an unsaturated heterocyclic group, an alkoxyl group, an aryloxy group, an amino group or a hydrazino group; $G_{51}$ represents

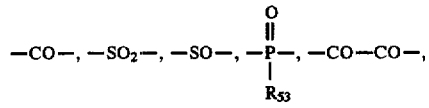

a thiocarbonyl group, or an iminomethylene group; $A_{51}$ and $A_{52}$ each represents a hydrogen atom, or either of them represents a hydrogen atom and the other represents a substituted or unsubstituted alkylsulfonyl group, or a substituted or unsubstituted arylsulfonyl group, or a substituted or unsubstituted acyl group; and $R_{53}$ has the same meaning as defined in $R_{52}$ and may be different from $R_{52}$.

14. The silver halide photographic material as claimed in claim 13, wherein said hydrazine derivatives represented by the formula (II) is added in an amount of from $1\times10^{-6}$ mol to $5\times10^{-2}$ mol per mol of the silver halide.

15. The silver halide photographic material as claimed in claim 14, wherein said hydrazine derivatives represented by the formula (II) is added in an amount of from $1\times10^{-5}$ mol to $2\times10^{-2}$ mol per mol of the silver halide.

* * * * *